US007796928B2

(12) United States Patent
Kinoshita et al.

(10) Patent No.: US 7,796,928 B2
(45) Date of Patent: Sep. 14, 2010

(54) IMAGE FORMING APPARATUS

(75) Inventors: Hidehiko Kinoshita, Kashiwa (JP); Jun Yamaguchi, Fujisawa (JP); Atsushi Nakagawa, Toride (JP); Masaaki Moriya, Moriya (JP); Manabu Mizuno, Toride (JP)

(73) Assignee: Canon Kabushiki Kaisha (JP)

( * ) Notice: Subject to any disclaimer, the term of this patent is extended or adjusted under 35 U.S.C. 154(b) by 708 days.

(21) Appl. No.: 11/692,994

(22) Filed: Mar. 29, 2007

(65) Prior Publication Data

US 2007/0231021 A1 Oct. 4, 2007

(30) Foreign Application Priority Data

Mar. 31, 2006 (JP) ..... 2006-098770

(51) Int. Cl.
*G03G 15/01* (2006.01)

(52) U.S. Cl. ..... 399/301; 399/49; 399/302

(58) Field of Classification Search ..... 399/49, 399/301, 302

See application file for complete search history.

(56) References Cited

U.S. PATENT DOCUMENTS 4,705,386 A * 11/1987 Ogita et al. ..... 399/76
4,956,662 A * 9/1990 Sakai et al. ..... 399/395
5,096,044 A * 3/1992 Biebel ..... 198/502.4
6,101,359 A * 8/2000 Tamura ..... 399/301
6,721,528 B1 * 4/2004 Schreieder et al. ..... 399/302

FOREIGN PATENT DOCUMENTS

JP 2000-071522 A 3/2000
JP 2000089529 A * 3/2000
JP 2004-184468 A 7/2004

OTHER PUBLICATIONS

English Abstract of JP2000089529 to Kurahashi et al.*

* cited by examiner

*Primary Examiner*—Ryan D Walsh
(74) *Attorney, Agent, or Firm*—Rossi, Kimms & McDowell LLP

(57) ABSTRACT

An image forming apparatus which can reduce color shift and image blurring caused by increased temperature in the apparatus and form high-quality images without causing an increase in the cost and size of the apparatus. An image sensor unit reads surface patterns of an intermediate transfer belt. A digital signal processor (DSP) controls the movement of the belt in a transverse direction perpendicular to a moving direction thereof based on the surface patterns of the belt read by the image sensor unit.

4 Claims, 25 Drawing Sheets

FIG. 21A

NUMBER OF PIXELS WITH HIGH DENSITIES

| COEFFICIENT | 7 | 6 | 5 | 4 | 3 | 2 | 1 | 0 | | PARTIAL SUM | |
|---|---|---|---|---|---|---|---|---|---|---|---|
| 7 | 0 | 1 | 0 | 0 | 0 | 0 | 0 | 0 | 1 | 7 | |
| 6 | 1 | 0 | 1 | 1 | 0 | 1 | 0 | 0 | 4 | 24 | |
| 5 | 0 | 1 | 1 | 1 | 1 | 0 | 0 | 0 | 4 | 20 | 163 |
| 4 | 0 | 0 | 1 | 1 | 1 | 1 | 0 | 0 | 4 | 16 | |
| 3 | 0 | 0 | 0 | 0 | 1 | 0 | 0 | 0 | 1 | 3 | |
| 2 | 0 | 0 | 0 | 0 | 0 | 0 | 0 | 0 | 0 | 0 | |
| 1 | 0 | 0 | 0 | 0 | 0 | 0 | 0 | 0 | 0 | 0 | |
| 0 | 0 | 0 | 0 | 0 | 0 | 0 | 0 | 0 | 0 | 0 | X CENTROID |
| NUMBER OF PIXELS WITH HIGH DENSITIES | 1 | 2 | 3 | 3 | 3 | 2 | 0 | 0 | 14 | 70 | 5 |
| PARTIAL SUM | 7 | 12 | 15 | 12 | 9 | 4 | 0 | 0 | 59 | | |
| | | | | | | | | Y CENTROID | 4.21 | | |

FIG. 21B

NUMBER OF PIXELS WITH HIGH DENSITIES

| COEFFICIENT | 7 | 6 | 5 | 4 | 3 | 2 | 1 | 0 | | PARTIAL SUM | |
|---|---|---|---|---|---|---|---|---|---|---|---|
| 7 | 0 | 0 | 0 | 0 | 0 | 0 | 0 | 0 | 0 | 0 | 164 |
| 6 | 0 | 0 | 0 | 0 | 0 | 0 | 0 | 0 | 0 | 0 | |
| 5 | 0 | 0 | 0 | 0 | 0 | 0 | 0 | 0 | 0 | 0 | |
| 4 | 0 | 0 | 0 | 1 | 0 | 0 | 0 | 0 | 1 | 4 | |
| 3 | 0 | 0 | 1 | 0 | 1 | 1 | 0 | 1 | 4 | 12 | |
| 2 | 0 | 0 | 0 | 1 | 1 | 1 | 1 | 0 | 4 | 8 | |
| 1 | 0 | 0 | 0 | 0 | 1 | 1 | 1 | 1 | 4 | 4 | |
| 0 | 0 | 0 | 0 | 0 | 0 | 0 | 1 | 0 | 1 | 0 | X CENTROID |
| NUMBER OF PIXELS WITH HIGH DENSITIES | 0 | 0 | 1 | 2 | 3 | 3 | 3 | 2 | 14 | 28 | 2 |
| PARTIAL SUM | 0 | 0 | 5 | 8 | 9 | 6 | 3 | 0 | 31 | | |
| | | | | | | | | Y CENTROID | 2.21 | | |

IMAGE FORMING APPARATUS

BACKGROUND OF THE INVENTION

1. Field of the Invention

The present invention relates to an image forming apparatus such as a color copying machine or a color laser printer.

2. Description of the Related Art

As shown in FIG. 24, an image forming apparatus 1001 which is a conventional image forming apparatus is comprised of a transfer belt 1005 as a transfer material bearing member that carries and conveys transfer materials P. In the image forming apparatus 1001, process cartridges (hereinafter merely referred to as the cartridges) for yellow (Y), magenta (M), cyan (C), and black (Bk) are arranged in tandem along a transfer material bearing surface of the transfer belt 1005. Above the cartridges 1014 to 1017, optical units 1018, 1019, 1020, and 1021 are arranged in association with the respective cartridges 1014 to 1017. Below the cartridges 1014 to 1017, transfer rollers 1010, 1011, 1012, and 1013 associated with respective photosensitive drums 1006, 1007, 1008, and 1019 which are image bearing members for the respective cartridges 1014 to 1017 are arranged with the transfer belt 1005 interposed therebetween.

With the above arrangement, yellow, magenta, cyan, and black toner images obtained by a known electrophotographic process are transferred in a superposed manner onto a transfer material P fed from a sheet cassette 1002 to the transfer belt 1005 by a pickup roller 1003 and a sheet feed and conveying roller pair 1029. The toner images transferred onto the transfer material P are fixed by a fixing unit 1022 and discharged from the apparatus via a discharged sheet sensor 1024 and a sheet path 1023.

To form toner images on the reverse side of the transfer material P as well, the transfer material P is conveyed to the transfer belt 1005 again via another sheet path 1025 after having passed through the fixing unit 1022, and toner images are formed on the reverse side of the transfer material P in a manner similar to the above described manner.

It should be noted that the transfer belt 1005 is rotatively driven by a transfer belt drive roller 1004.

In the image forming apparatus 1001, the optical units 1018 to 1021 for the respective colors scan the surfaces of the respective photosensitive drums 1006 to 1009 by exposing them to laser beams L1, L2, L3, and L1, whereby latent images are formed on the surfaces of the respective photosensitive drums 1006 to 1009. In the sequence of image forming operations carried out in the image forming apparatus 1001, the laser beams L1, L2, L3, and L4 are controlled to perform scanning in synchronization so that the transfer of images can be started at predetermined locations on a transfer material P being conveyed.

The image forming apparatus 1001 is comprised of a sheet feed and conveying motor that drives the sheet feed and conveying roller pair 1029, a transfer belt drive motor that drives the transfer belt drive roller 1004, a photosensitive drum drive motor that drives the respective color photosensitive drums 1006 to 1009, a fixing roller drive motor that drives a fixing roller pair 1022*a* of the fixing unit 1022, and so on (none of them is illustrated). In order to form satisfactory images, these motors are controlled to fixed rotational speeds.

With the conventional image forming apparatus, however, there may be a case where the inside temperature is increased due to temperature control of a heater incorporated in the fixing unit and/or heating of the drive motors, and the transfer belt drive roller thermally expands due to the increased temperature, causing an increase in the speed of the transfer belt.

In such a case, when toner images of respective colors are transferred in a superposed manner onto a specific position on a transfer material, so-called color shift occurs to cause significant degradation of image quality. Specifically, since the photosensitive drums and the transfer belt drive roller are controlled to rotate at fixed speeds, the circumferential velocity of the transfer belt drive roller increases as the diameter of the transfer belt drive roller increases due to thermal expansion, and as a result, the speed of the transfer belt increases, which causes color shift.

As an example of methods to solve such a problem, there is a method in which a color shift detecting pattern is formed on the transfer belt and read by a sensor to detect the relative amounts of color shift of respective colors, and the start positions of image writing by laser beams for the respective colors are corrected based on the detection result, that is, registration correction is carried out. This method, however, has the following problems:

(1) Although the start positions of image writing for respective colors can be in registration immediately after registration correction, the circumferential velocity of the transfer belt gradually increases, for example, in the case of continuous printing since the temperature in the apparatus further increases, and thus, after completion of printing on a plurality of sheets, the amount of color shift is large.

(2) To solve this problem, for example, registration correction may be carried out each time printing on a predetermined number of sheets is completed, but frequent registration correction would decrease the throughput of the image forming apparatus. In addition, since a registration correcting pattern is formed on the transfer belt during registration correction, the consumption of toners is increased, which causes degradation of cost-efficiency for users.

As another example of methods to correct for color shift, there is a method in which a registration reference mark is formed in advance on the transfer belt and detected by a CCD sensor, and image writing positions are corrected based on the detection result (see Japanese Laid-Open Patent Publication (Kokai) No. 2000-071522, for example).

In this method, however, due to the need for forming the reference mark in advance on the transfer belt, the manufacturing cost of the transfer belt is high, and the apparatus has to be wide so as to ensure a space for the reference mark on the transfer belt.

Such a problem also arises in an image forming apparatus having an intermediate transfer member.

Further, the conventional image forming apparatus is provided with the sheet feed and conveying roller pair for feeding and conveying transfer materials. When the speed of the transfer belt increases with an increase in temperature in the apparatus, a difference between the transfer material conveying force exerted by the sheet feed and conveying roller pair and the transfer material conveying force exerted by the transfer belt increases, causing color shift and image blurring. When the transfer material conveying force exerted by the sheet feed and conveying roller pair is greater than the transfer material conveying force exerted by the transfer belt, a transfer material is more likely to be pushed in the conveying direction. In this case, image blurring occurs at the trailing end of the transfer material if the transfer material that is relatively elastic, such as thick paper.

On the other hand, there is the problem that, when the transfer material conveying force exerted by the transfer belt is greater than the transfer material conveying force exerted by the sheet teed and conveying roller pair, image blurring or color shift occurs at the leading end of the transfer material.

SUMMARY OF THE INVENTION

The present invention provides an image forming apparatus that can reduce color shift and image blurring caused by increased temperature in the apparatus and form high-quality images without causing an increase in the cost and size of the apparatus.

In an aspect of the present invention, there is provided an image forming apparatus comprising a belt, a reading unit adapted to read surface patterns of the belt, and a controller adapted to control movement of the belt in a transverse direction perpendicular to a moving direction thereof based on the surface patterns of the belt read by the reading unit.

According to the present invention, color shift and image blurring caused by increased temperature in the apparatus can be reduced without causing an increase in the cost and size of the apparatus. Thus, high-quality images can be formed.

The above and other objects, features, and advantages of the invention will become more apparent from the following detailed description taken in conjunction with the accompanying drawings.

BRIEF DESCRIPTION OF THE DRAWINGS

FIGS. 21A and 21B are diagrams showing respective results of centroid computations based on the binarized images in FIGS. 20A and 20B.

DETAILED DESCRIPTION OF THE PREFERRED EMBODIMENTS

The present invention will now be described in detail with reference to the drawings showing preferred embodiments thereof.

First, a description will now be given of an image forming apparatus according to a first embodiment of the present invention.

Figure 1:
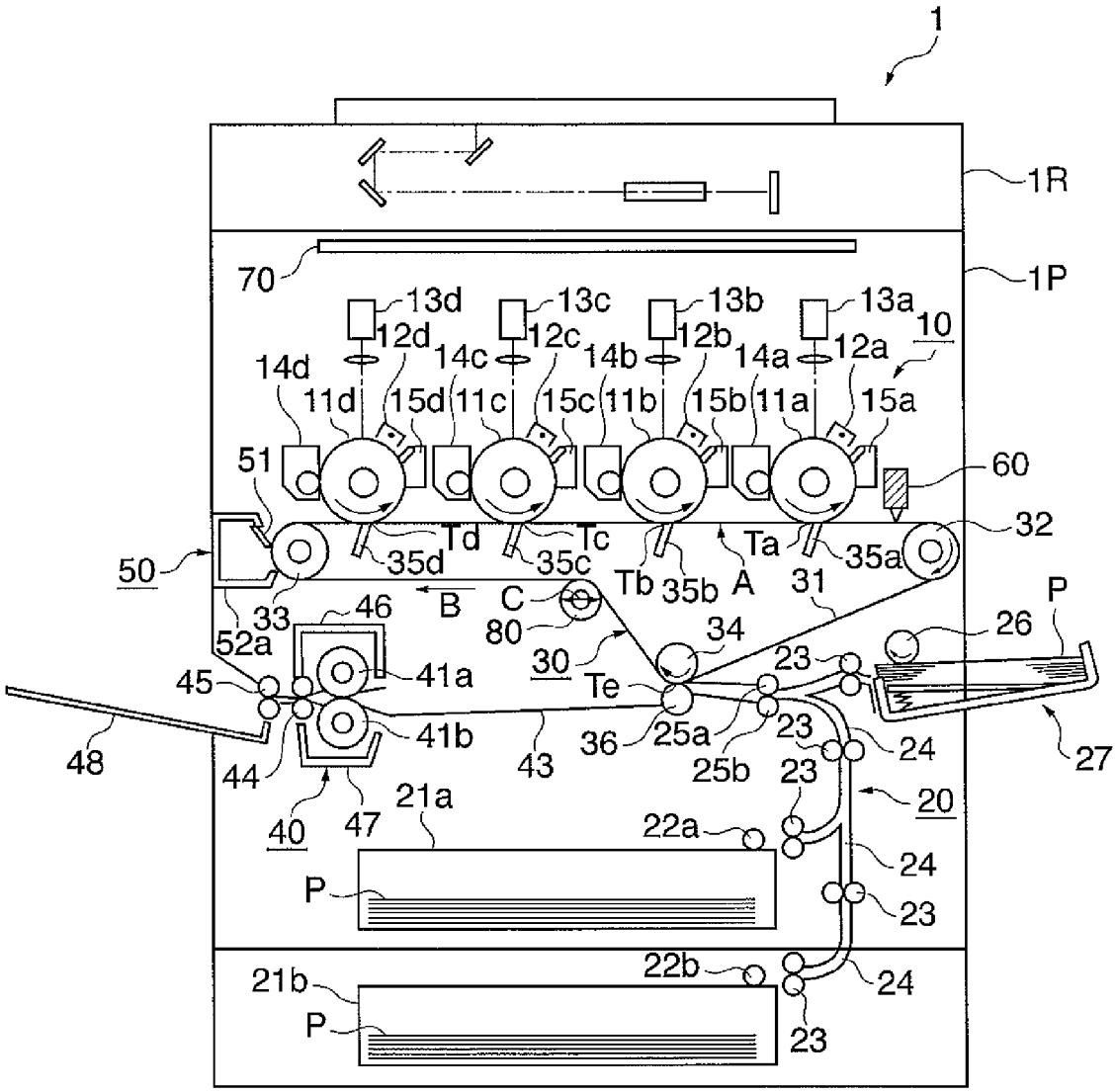
FIG. 1 is a sectional view showing the essential parts of an image forming apparatus according to a first embodiment of the present invention.

FIG. 1 is a sectional view showing the essential parts of the image forming apparatus according to the first embodiment. As shown in FIG. 1, the image forming apparatus 1 according to the first embodiment is a color image forming apparatus comprised of a plurality of image forming sections arranged side by side.

The image forming apparatus 1 is of an electrophotographic type and comprised of an optical system 1R and an image output section 1P. The optical system 1R reads images on originals, and the image output section 1P forms images on transfer materials P based on image information read by the optical system 1R. The image output section 1P is comprised mainly of an image forming section 10, a sheet feed unit 20, an intermediate transfer unit 30, a fixing unit 40, and a controller including a control board 70. In the image forming section 10, four stations identical in construction are arranged side by side.

A detailed description will now be given of the above-mentioned units. In the image forming section 10, photosensitive drums 11*a*, 11*b*, 11*c*, and 11*d* which are image bearing members rotatively driven in directions indicated by arrows in FIG. 1 are pivotally supported at centers thereof. Also, in the image forming section 10, primary electrostatic chargers 12 (12*a*, 12*b*, 12*c*, and 12*d*), optical systems 13 (13*a*, 13*b*, 13*c*, and 13*d*), and developing devices 14 (14*a*, 14*b*, 14*c*, and 14*d*) are arranged in opposed relation to outer circumference surfaces of the photosensitive drums 11*a* to 11*d* and in the rotational directions of the photosensitive drums 11*a* to 11*d*.

As will be described later, the image forming section 10 is also provided with a Y drum drive motor 52, an M drum drive motor 53, a C drum drive motor 54, and a Bk drum drive motor 55 that rotatively drive the photosensitive drums 11*a*, 11*b*, 11*c*, and 11*d*, respectively. Moreover, as will be described later, the image forming section 10 is also provided with a Y scanner motor unit 63, an M scanner motor unit 64, a C scanner motor unit 65, a Bk scanner motor unit 66 for scanning the photosensitive drums 11*a*, 11*b*, 11*c*, and 11*d*, respectively, with rays of light.

In the image forming section 10, the primary electrostatic chargers 12*a* to 12*d* uniformly charge respective surfaces of the respective photosensitive drums 11*a* to 11*d*. Then, the optical systems 13*a* to 13*d* use the scanner motor units 63, 64, 65, and 66 to expose the photosensitive drums 11*a* to 11*d* to rays of light such as laser beams modulated based on recording image signals, whereby electrostatic latent images are formed on the respective photosensitive drums 11*a* to 11*d*. The developing devices 14*a* to 14*d* storing developing agents (toners) of four colors, i.e. yellow, magenta, cyan, and black then visualize the respective electrostatic latent images as toner images. It should be noted that at locations downstream of primary transfer areas Ta, Tb, Tc, and Td in which visualized toner images are transferred onto an intermediate transfer belt 31 which is a belt member, residual toner remaining on the photosensitive drums 11*a* to 11*d* without being transferred onto transfer materials P are scarped off by cleaning devices 15 (15*a*, 15*b*, 15*c*, and 15*d*) to clean off the surfaces of the photosensitive drums 11*a* to 11*d*. By the above-described process, images are sequentially formed using toners of respective colors.

As shown in FIG. 1, the sheet feed unit 20 is comprised of cassettes 21 (21*a* and 21*b*) for storing transfer materials P, a manual feed tray 27, and pickup rollers 22*a*, 22*b*, and 26 for feeding transfer materials P one by one from the cassette 21*a* or 21*b* or the manual feed tray 27. The sheet feed unit 20 is also comprised of resist rollers 25*a* and 25*b* for feeding transfer materials P toward a secondary transfer area Te in synchronization with timing in which images are formed by the image forming section 10, and a feed roller pair 23 and a feed guide 24 for conveying transfer materials P fed from the pickup rollers 22*a*, 22*b*, and 26 to the resist rollers 25*a* and 25*b*.

The sheet feed unit 20 is also comprised of a sheet feed motor unit 62 provided with sheet feed motors that rotatively drive the pickup rollers 22*a*, 22*b*, and 26, feed roller pair 23, and resist rollers 25*a* and 25*b*, respectively, as will be described later.

The intermediate transfer unit 30 is provided with an intermediate transfer belt 31 which is an intermediate transfer member. The intermediate transfer belt 31 is tensely wound on a transfer belt drive roller (downstream roller) 32 that transfers drive power to the intermediate transfer belt 31, a tension roller (upstream roller) 33 that applies suitable tension to the intermediate transfer belt 31 using an urging force generated by a spring (elastic member), not shown, a secondary transfer inside roller 34 disposed in opposed relation to the secondary transfer area Te with the intermediate transfer belt 31 interposed therebetween, and an outside roller 80. The outside roller 80 is provided on the outer side of the intermediate transfer belt 31 and between the secondary transfer area Te and the primary transfer area Td in a direction in which transfer materials P are conveyed (direction indicated by an arrow B). It should be noted that examples of the material of the intermediate transfer belt 31 include PET (polyethylene terephthalate) and PVdF (polyvinylidene fluoride).

As shown in FIG. 1, a primary transfer plane A is formed on an upper surface of the intermediate transfer belt 31 and in an area between the transfer belt drive roller 32 and the tension roller 33. The transfer belt drive roller 32 is a metallic roller with a surface thereof coated with rubber (urethane or chloroprene) with a thickness of several millimeters so as to prevent slip between the transfer belt drive roller 32 and the intermediate transfer belt 31.

In the primary transfer areas Ta to Td in which the photosensitive drums 11*a* to 11*d* and the intermediate transfer belt 31 are opposed to each other, primary transfer devices 35*a*, 35*b*, 35*c*, and 35*d* disposed in opposed relation to the respective photosensitive drums 11*a* to 11*d* with the intermediate transfer belt 31 interposed therebetween are disposed. Also, a secondary transfer device 36 is disposed in opposed relation to the secondary transfer inside roller 34 with the intermediate transfer belt 31 interposed therebetween to form the secondary transfer area Te.

A cleaning device 50 for cleaning off the surface of the intermediate transfer belt 31 having images formed thereon is disposed at a location downstream of the secondary transfer area Te of the intermediate transfer belt 31. The cleaning device 50 is comprised of a cleaner blade 51 and a waste toner box 52*a* for storing waste toners. It should be noted that examples of the material of the cleaner blade 51 include urethane rubber.

As will be described later, the intermediate transfer unit 30 is also comprised of a transfer belt drive motor 56 which is a transfer bearing member drive motor that rotatively drives the transfer belt drive roller 32, and a high-voltage unit 59 that applies high voltage to the primary transfer devices 35*a* to 35*d* and the secondary transfer device 36.

As shown in FIG. 1, the fixing unit 40 is comprised of a fixing roller 41*a* having a heat source such as a halogen heater incorporated therein, a pressurizing roller 41*b* pressed against the fixing roller 41*a* by pressure, a guide 43 for guiding transfer materials P to a nipped part between the fixing roller 41*a* and the pressurizing roller 41*b*, an inner sheet discharge roller pair 44 and an outer sheet discharge roller pair 45 for guiding transfer materials P discharged from the fixing roller 41*a* and the pressurizing roller 41*b* to the outside of the image forming apparatus 1. The pressurizing roller 41*b* may be provided with a heat source. The fixing unit 40 is also comprised of a fixing roller drive motor 57 that rotatively drives the fixing roller 41*a* as will be described later.

The above-mentioned controller is comprised of a control board, a motor drive board, and so on for controlling operations of mechanisms of the above-mentioned units.

Also, in the image forming apparatus 1, the intermediate transfer unit 30 is comprised of an alignment adjusting mechanism for the outside roller 80, described later, and an image sensor unit 60 which is a reading unit that reads surface patterns of the intermediate transfer belt 31 so as to control the moving speed of the intermediate transfer belt 31 by controlling the rotational speed of the transfer belt drive roller 32. As shown in FIG. 1, the image sensor unit 60 is disposed in the vicinity of the photosensitive drum ha and the intermediate transfer belt 31. The image sensor unit 60 irradiates light onto the surface of the intermediate transfer belt 31, gathers reflected light from the surface of the intermediate transfer belt 31 to form an image, and outputs a surface image indicative of a surface pattern in a specific area on the intermediate transfer belt 31.

Next, a description will be given of the basic operation of the image forming apparatus 1 constructed as described above.

When an image forming operation start signal is issued in response to a predetermined operation by a user, first, transfer materials P are fed one by one from the cassette 21*a* by the pickup roller 22*a*. Each of the transfer materials P is then conveyed on the feed guides 24 by the feed roller pairs 23 to the resist rollers 25*a* and 25*b*. When the transfer material P reaches the resist rollers 25*a* and 25*b*, the resist rollers 25*a* and 25*b* are standing still, and hence the leading end of the transfer material P abuts against the nipped part. Thereafter, the resist rollers 25*a* and 25*b* start rotating in synchronization with timing in which the image forming section 10 starts image formation. The timing in which the resist rollers 25*a* and 25*b* start rotating is set so that the transfer material P and toner images primarily transferred onto the intermediate transfer belt 31 by the image forming section 10 can be simultaneously conveyed in the secondary transfer area Te.

On the other hand, in the image forming section 10, a toner image formed on the photosensitive drum 11*d* disposed in the uppermost stream side in the rotational direction of the intermediate transfer belt 31 is primarily transferred onto the intermediate transfer belt 31 in the primary transfer area Td by the primary transfer device 35*d* with high voltage applied thereto. The toner image primarily transferred onto the intermediate transfer belt 31 is then conveyed to the next primary transfer area Tc, and a toner image formed on the photosensitive drum 11*c* is transferred onto the toner image, which has been primarily transferred onto the intermediate transfer belt 31, by the primary transfer device 35*c*. In the primary transfer area Tc, the transfer of the toner image is carried out after a time lag corresponding to the time between the transfer of the toner image in the primary transfer area Td and the conveyance of the toner image to the primary transfer area Tc. Thus, the next toner image is transferred onto the previously transferred toner image in such a manner that they are in registration. The same processing is repeatedly carried out in the primary transfer areas Tb and Ta as well as in the primary transfer areas Td and Tc, and as a result, the toner images of the four colors are primarily transferred onto the intermediate transfer belt 31.

After that, when the transfer material P enters the secondary transfer area Te and comes into contact with the intermediate transfer belt 31, high voltage is applied to the secondary transfer roller 36 in synchronization with timing in which the transfer material P passes the secondary transfer roller 36. As a consequence, the toner images of the four colors formed on the intermediate transfer belt 31 by the above-described process are collectively transferred onto the surface of the transfer material P. The transfer material P onto which the toner images have been transferred is then accurately guided to the nipped part between the fixing roller 41*a* and the pressurizing roller 41*b* of the fixing unit 40 by the conveying guide 43. The toner images are then fixed on the surface of the transfer material P by heat from the rollers 41*a* and 41*b* of the fixing unit 40 and pressure from the nipped part. The transfer material P having the toner images fixed thereon is then conveyed by the inner discharge roller pair 44 and the outer discharge roller pair 45 and discharged from the image forming apparatus 1.

Also, the image forming apparatus 1 can perform alignment of the outside roller 80 of the intermediate transfer unit 30. Specifically, the outside roller 80 has a rear end portion thereof in FIG. 1 pivotally supported by a bearing, not shown, and has a front end portion in FIG. 1 thereof caused to move in a direction indicated by an arrow C in FIG. 1 by an alignment adjusting mechanism in FIG. 2, described later. That is, the outside roller 80 is configured to be aligned by the alignment adjusting mechanism, and the alignment of the outside roller 80 is performed through operation of the alignment adjusting mechanism.

Figure 2:
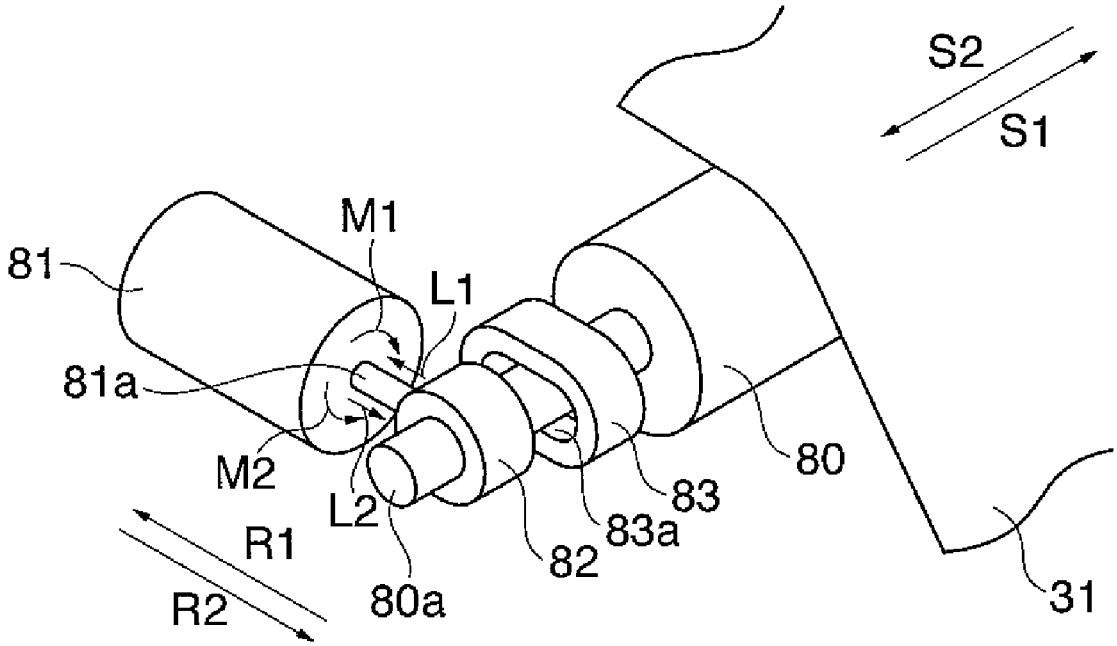
FIG. 2 is a perspective view showing an alignment adjusting mechanism for an outside roller in the image forming apparatus in FIG. 1.

FIG. 2 is a perspective view showing the alignment adjusting mechanism for the outside roller 80.

As shown in FIG. 2, the alignment adjusting mechanism is comprised of the outside roller 80, a steering motor 81, a bearing 82, and an elongated bearing 83.

A shaft end portion 80*a* in the front part of the outside roller 80 is pivotally supported by the elongated bearing 83 fixed to a side plate, not shown, such that it can rotate. In the elongated bearing 83, an elongated hole 83*a* that supports the shaft end portion 80*a* such that the shaft end portion 80*a* can move in two directions indicated by arrows R1 and R2 (direction indicated by the arrow C in FIG. 1) and rotate. It should be noted that, at a location in front of the elongated bearing 83, the bearing 82 is engaged with the shaft end portion 80*a*. The steering motor 81 is fixed to the above-mentioned side plate, not shown. The output shaft 81*a* provided with a lead is mounted on an end of the steering motor 81, and an end of the output shaft 81*a* is in contact with the bearing 82. A spring member, not shown, is provided on the other side of the bearing 82, for pressing the bearing 82 against the output shaft 81*a* by urging it in the direction indicated by the arrow R1.

In the alignment adjusting mechanism described above, when the steering motor 81 is turned a predetermined number of steps in a direction indicated by an arrow M1, the output shaft 81*a* moves a predetermined amount in a direction indicated by an arrow L1, and the bearing 82 moves a predetermined amount in the direction indicated by the arrow L1. On the other hand, when the steering motor 81 is turned a predetermined number of steps in a direction indicated by an arrow M2, the output shaft 81*a* moves a predetermined amount in a direction indicated by an arrow L2, and the bearing 82 moves a predetermined amount in the direction indicated by the arrow L2. By rotating the steering motor 81 in this manner, the shaft end portion 80*a* in the front part of the outside roller 80 can be moved in the direction indicated by the arrow R1 or R2. Thus, the outside roller 80 can be aligned.

By aligning the outside roller 80 using the alignment adjusting mechanism described above, the direction in which the intermediate transfer belt 31 is shifted can be controlled. When the shaft end portion 80*a* in the front part of the outside roller 80 is moved in the direction indicated by the arrow R1, a force that shifts the intermediate transfer belt 31 in a direction indicated by an arrow S2 is exerted on the intermediate transfer belt 31. On the other hand, when the shaft end portion 80*a* in the front part of the outside roller 80 is moved in the direction indicated by the arrow R2, a force that shifts the intermediate transfer belt 31 in a direction indicated by an arrow S1 is exerted on the intermediate transfer belt 31. By aligning the outside roller 80 using such characteristics, a shifting force in such a direction as to cancel a shifting force exerted on the intermediate transfer belt 31 by, for example, distortion of a main body of the apparatus is positively exerted on the intermediate transfer belt 31, so that the intermediate transfer belt 31 can move without deviating from a predetermined position.

Figure 3:
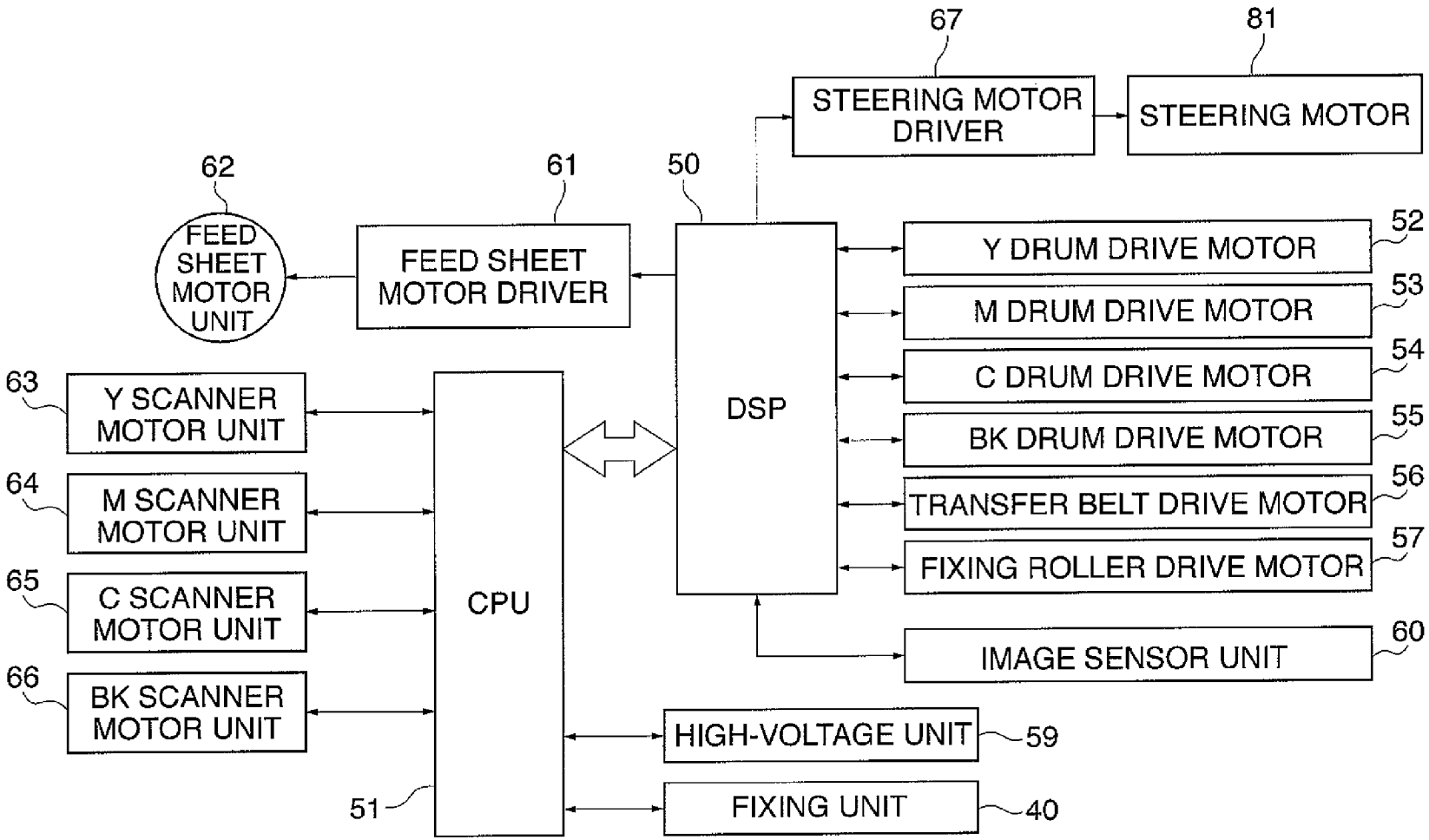
FIG. 3 is a circuit block diagram showing the electrical configuration of the interior of the image forming apparatus in FIG. 1.

Next, a description will be given of the electrical configuration of the image forming apparatus 1. FIG. 3 is a circuit block diagram showing the electrical configuration of the interior of the image forming apparatus 1.

As shown in FIG. 3, the image forming apparatus 1 is comprised of a DSP (digital signal processor) 50, a CPU 51, a sheet feed motor driver 61 that controls the sheet feed motor unit 62, and a steering motor driver 67 that controls the steering motor 81.

Connected to the DSP 50 are the drum driver motors 52, 53, 54, and 55 for the respective colors that drive the photosensitive drums 11*a*, 11*b*, 11*c* and 11*d* for the respective colors, the transfer belt drive motor 56 that rotatively drives the transfer belt drive roller 32, the fixing roller drive motor 57 that rotatively drives the fixing roller 41*a*, the image sensor unit 60, the sheet feed motor driver 61, and the steering motor driver 67. Connected to the CPU 51 are the scanner motor units 63, 64, 65, and 66 for the respective colors that scan the photosensitive drums 11*a*, 11*b*, 11*c*, and 11*d* with rays of light, the fixing unit 40, and the high-voltage unit 59 that applies high voltage to the primary transfer devices 35*a*, 35*b*, 35*c*, and 35*d* and the secondary transfer device 36.

The drum drive motors 52 to 55, transfer belt drive motor 56, fixing roller drive motor 57, image sensor unit 60, sheet feed motor driver 61, and steering motor driver 67 are controlled by the DSP 50. The scanner units 63 to 66, high voltage unit 59, and fixing unit 40 are controlled by the CPU 51.

Figure 4:
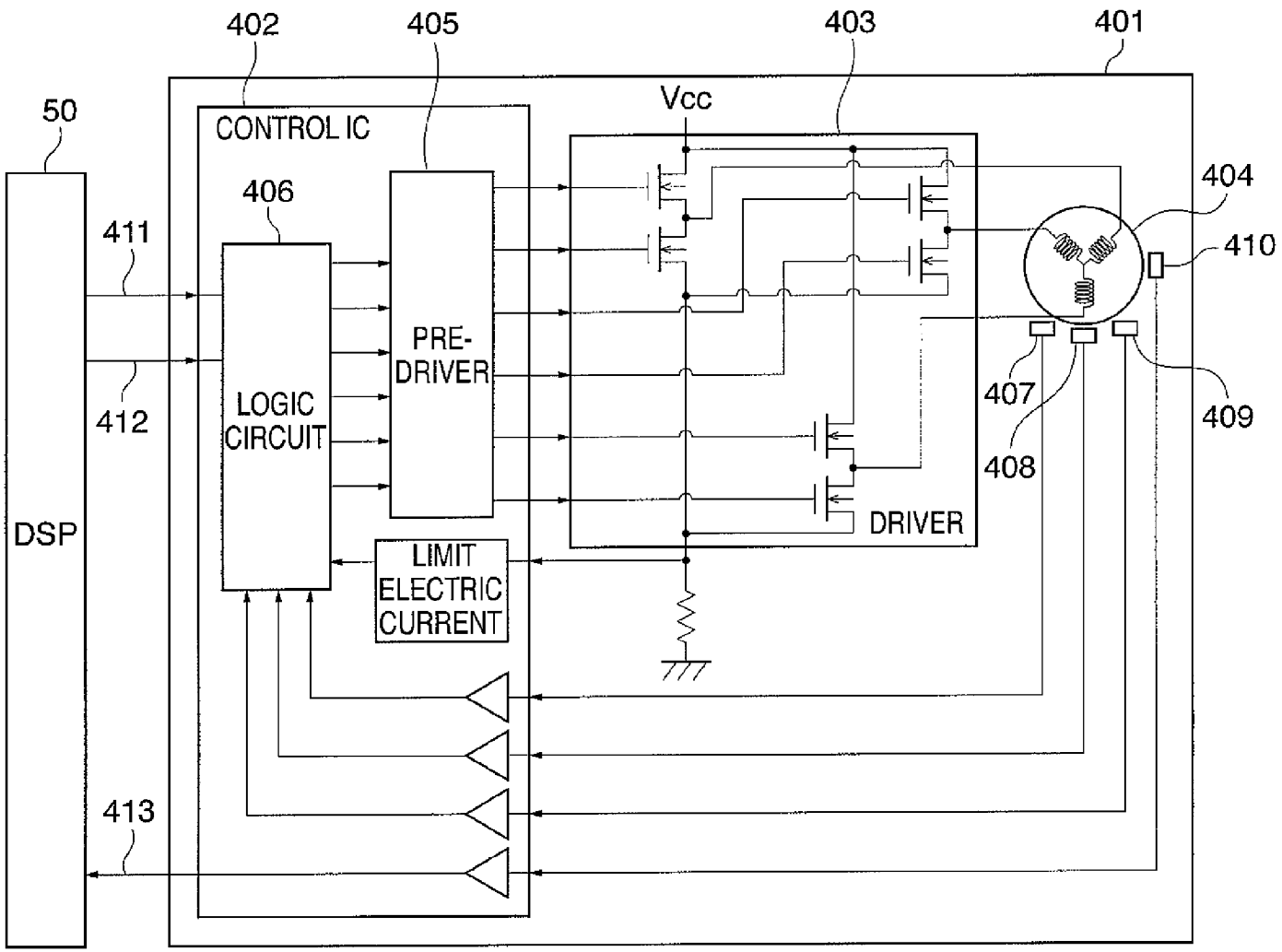
FIG. 4 is a block diagram showing the construction of a DC motor unit in the image forming apparatus in FIG. 1.

Referring next to FIG. 4, a brief description will be given of the constructions of the drum drive motors 52 to 55 and the transfer belt drive motor 56, which are controlled by the DSP 50. The drum drive motors 52 to 55 and the transfer belt drive motor 56 are implemented by a DC motor unit 401 having a three-phase DC motor 404 appearing in FIG. 4 incorporated therein.

As shown in FIG. 4, the DC motor unit 401 is provided with a control IC 402 and a driver 403 as well as the three-phase DC motor 404. The control IC 402 is provided with a pre-driver 405 and a logic circuit 406. The DC motor unit 401 is connected to the control IC 402 and comprised of three hall sensors 407, 408, and 409 and a speed detecting MR sensor 410, which are arranged in the vicinity of the three-phase DC motor 404.

The DSP 50 computes the motor rotational speed from a speed detection signal 413 from the speed detecting MR sensor 410 and controls a PWM signal 412 so that the rotational speed (RPM) of the three-phase DC motor 404 can be a target speed. The control IC 402 changes electric current to be supplied to coils based on the detected signal from the hall sensors 407 to 409 so that electric current can be passed through the coils in desired directions. Electric current output from the control IC 402 is amplified by the driver 403 based on the PWM signal 412, and the amplified electric current is supplied to each coil of the three-phase DC motor 404. It should be noted that in FIG. 4, reference numeral 411 denotes a motor starting signal as a command for starting the three-phase DC motor 404.

Figure 5:
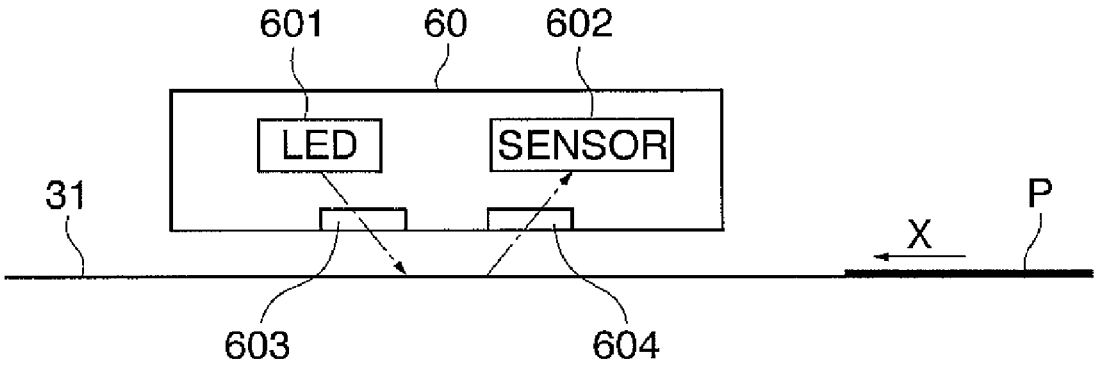
FIG. 5 is a diagram schematically showing the construction of an image sensor unit in the image forming apparatus in FIG. 1.

Referring next to FIG. 5, a description will be given of the construction of the image sensor unit 60. FIG. 5 is a diagram schematically showing the construction of the image sensor unit 60.

As shown in FIGS. 1 and 5, the image sensor unit 60 is arranged in opposed relation to the intermediate transfer belt 31 in the image forming section 10 and comprised of an LED 601 that is an illumination member, a CMOS sensor 602 that is a photoelectric conversion element, a lens 603, and an image-forming lens 604. Light emitted from the LED 601 is irradiated in a slanting direction onto the surface of the intermediate transfer belt 31 or the surface of a transfer material P via the lens 603. Light reflected from the light irradiated onto the intermediate transfer belt 31 or the transfer material P is gathered via the image-forming lens 604 to form an image on the CMOS sensor 602. In this way, the image sensor unit 60 reads a surface pattern of the intermediate transfer belt 31 or a surface image of the transfer material P to create corresponding image data. Although in the present embodiment, the LED is used as the illumination member, the illumination member should not necessarily be the LED but may be any other light source such as a laser light source.

Figure 6:
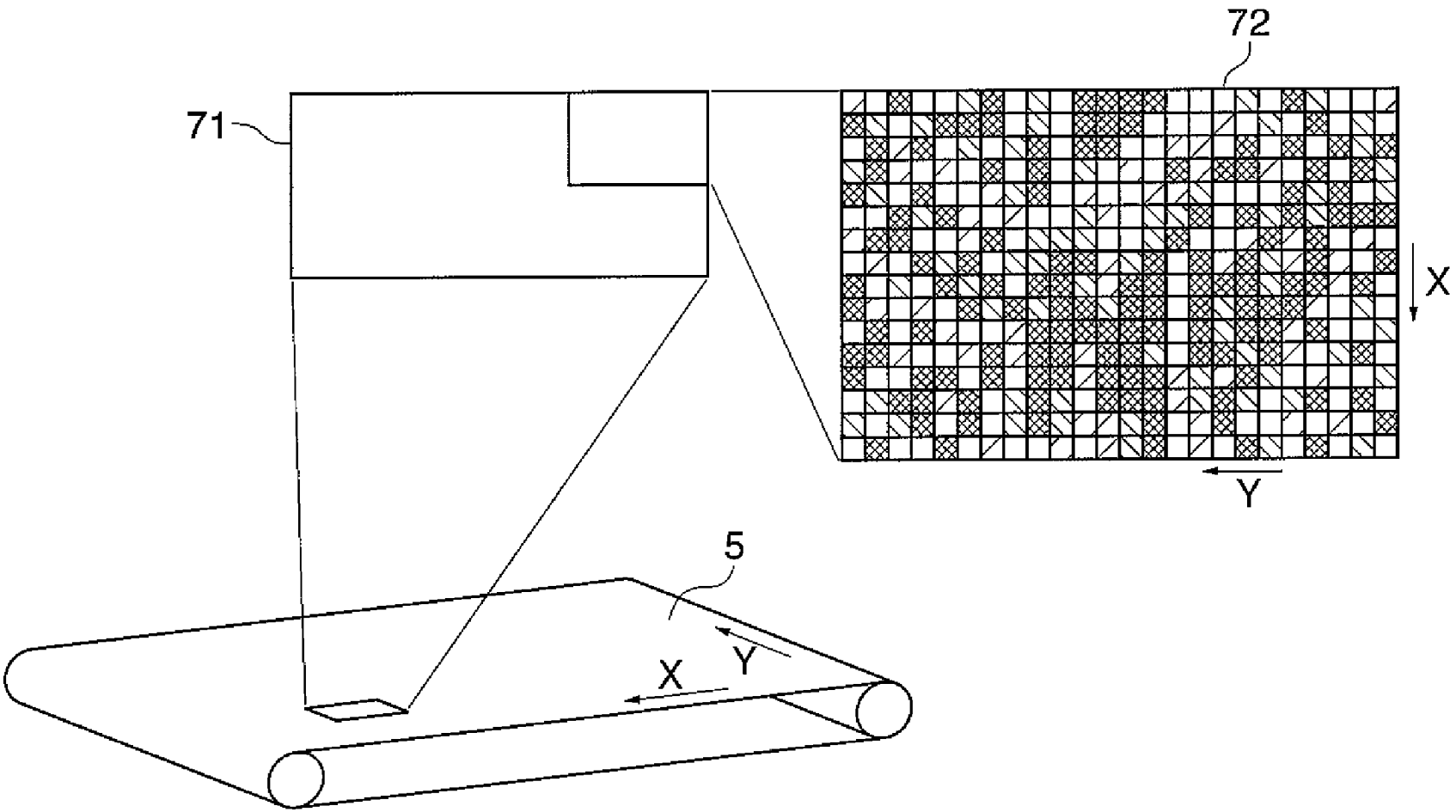
FIG. 6 is a diagram showing an example of a surface image of an intermediate transfer belt created by the image sensor unit in FIG. 5.

Referring next to FIG. 6, a description will be given of a surface image created by the image sensor unit 60. FIG. 6 is a view showing an example of a surface image of the intermediate transfer belt 31 created by the image sensor unit 60. As shown in FIG. 6, with the image sensor unit 60, a surface image indicative of a surface pattern of the intermediate transfer belt 31 can be enlarged into an enlarged image 71 by the image-forming lens 604. In FIG. 6, reference numeral 72 denotes an image obtained by detecting tones of a part of the enlarged image 71 with the CMOS sensor 602.

The surface of the intermediate transfer belt 31 has asperities formed by flaws, stains, and so on. Since the asperities generate shade therebehind by radiating light onto them in a slanting direction, a surface pattern can be easily detected by radiating light onto the surface of the intermediate transfer belt 31 in a slanting direction.

Also, by forming asperities in advance on a surface layer of the intermediate transfer belt 31 within such a range as not to affect the control of transfer for image formation, a surface pattern on the intermediate transfer belt 31 read by the CMOS sensor 602 can be further characterized.

Further, if the surface layer of the intermediate transfer belt 31 is made of a transparent material, by forming asperities or an arbitrary pattern in advance on an intermediate layer of the intermediate transfer belt 31, a surface pattern further characterized without affecting transfer can be detected by the CMOS sensor 602.

The image 72 appearing in FIG. 6 represents an example of a surface image created in a case where a surface pattern of the intermediate transfer belt 31 is read using the CMOS sensor 602 having 24×16 pixels each of which has a resolution of 8 bits. It should be noted that as the photoelectric conversion element of the image sensor unit 60, a CCD sensor may be used in place of the CMOS sensor 602.

Figure 7:
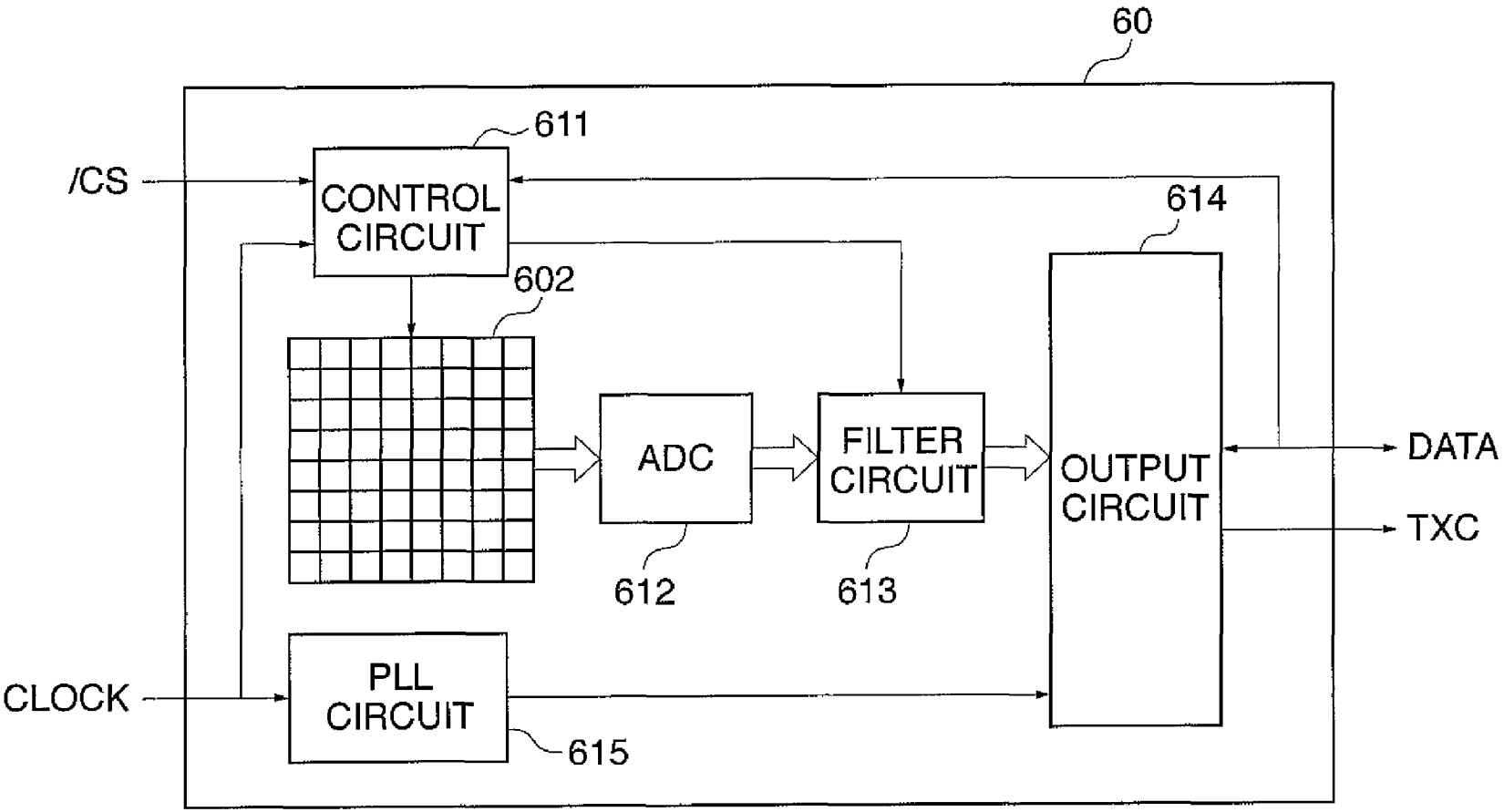
FIG. 7 is a circuit block diagram schematically showing the construction of the image sensor unit in FIG. 5.

Referring next to FIG. 7, a description will be given of the circuit construction of the image sensor unit 60. FIG. 7 is a circuit diagram schematically showing the construction of the image sensor unit 60.

As shown in FIG. 7, the image sensor unit 60 is comprised of the CMOS sensor 602 having 24×16 pixels, a control circuit 611, an A/D converter (A/D conversion circuit) 612, a filter circuit 613, an output circuit 614, and a PLL circuit 615.

Figure 8:
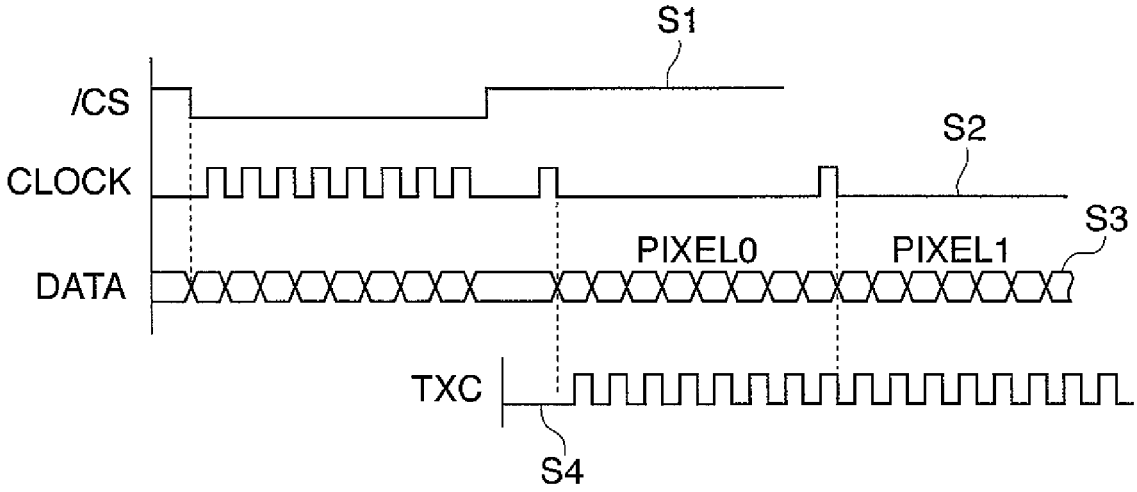
FIG. 8 is a diagram useful in explaining the circuit operation of the image sensor unit in FIG. 5.

Referring to FIG. 8, a description will be given of the circuit operation of the image sensor unit 60 having the circuit construction shown in FIG. 7. FIG. 8 is a diagram useful in explaining the circuit operation of the image sensor unit 60.

The DSP 50 transmits a ICS signal S1, a CLOCK signal S2, and a DATA signal S3 to the control circuit (Control Logic) 611 through serial communication and sets control parameters such as a filter constant for the filter circuit 613 of the control circuit 611.

By transmitting the low-level/CS signal S1 as shown in FIG. 8, the DSP 50 switches the operation mode to a control parameter transfer mode and transmits an 8-bit command signal as the DATA signal S3. In response to this command signal, the control circuit 611 controls the filter circuit 613 to determine the gain of the output of the CMOS sensor 602.

The purpose of setting the gain of the output 1C of the CMOS sensor 602 is for the image sensor unit 60 to constantly create optimum surface images since by adjusting the gain, for example, the reflectivity of the intermediate transfer belt 31 varies depending on its material.

The DSP 50 outputs a command signal for adjusting the gain for a surface pattern of the intermediate transfer belt 31 read by the CMOS sensor 602 to such a level as to realize an image comparison process, described later, with high accuracy. For example, the DSP 50 adjusts the gain of the output of the CMOS sensor 602 to such a level that a certain degree of contrast is formed in an image indicative of a read surface pattern.

The DSP 50 then transmits the high-level ICS signal S1 as shown in FIG. 8 to switch the operation mode to an image data transfer mode in which image data is transferred from the CMOS sensor 602. The CLOCK signal S2 triggers the output circuit (Output Logic) 614 to transmit digital image information converted from the output of the CMOS sensor 602 through the A/D converter 612 and the filter circuit 613 to the DSP 50 on a pixel-by-pixel basis. At this time, the PLL circuit 615 generates a transmission synchronization clock TXC S4 based on the CLOCK signal S2. In the above-described manner, the image sensor unit 60 sequentially creates 24×16-pixel data (PIXEL 0, 1, . . . , 8), and the DSP 50 sequentially receives the 24×16-pixel data (PIXEL 0, 1, . . . ).

Figure 9:
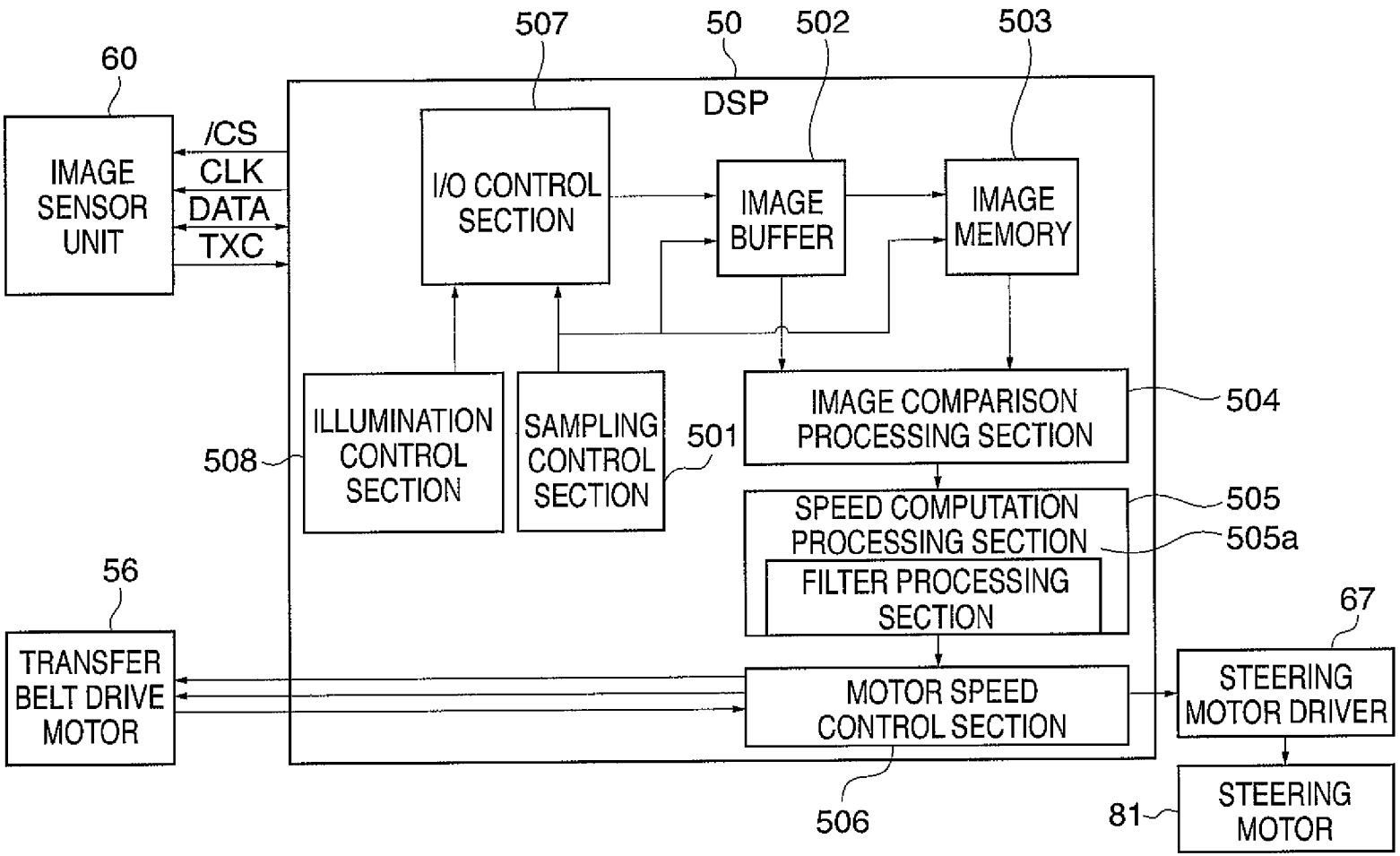
FIG. 9 is a block diagram schematically showing the construction of a DSP in the image forming apparatus in FIG. 1.

Referring next to FIG. 9, a brief description will be given of the construction of the DSP 50. FIG. 5 is a block diagram schematically showing the construction of the DSP 50.

As shown in FIG. 9, the DSP 50 is comprised of a sampling control section 501, an image buffer 502, an image memory 503, an image comparison processing section 504, a speed computation processing section 505, a motor speed control section 506, an I/O control section 507, and an illumination control section 508.

In the DSP 50, the sampling control section 501 functions as a sampling unit, which samples surface images indicative of surface patterns of the intermediate transfer belt 31 read from the CMOS sensor 602 at intervals of predetermined sampling periods. The image buffer 502 and the image memory 503 are storage devices. The image comparison processing section 504 carries out an image comparison process in a motor speed control process and a shift control process, described later. The speed computation processing section 505 carries out various computations in the motor speed control process and the shift control process as will be described later. The speed computation processing section 505 is also provided with a filter processing section 505*a* that carries out a filter process for removing noise and others from detection data.

The motor speed control section 506 controls the transfer belt drive motor 56 so that the running speed of the intermediate transfer belt 31 can be a target running speed in the motor speed control process as will be described later. The motor speed control section 506 drives the steering motor 81 of the alignment adjusting mechanism so that the shift amount of the intermediate transfer belt 31 can be within a predetermined range in the shift control process as will be described later.

The I/O control section 507 is an input/output section for carrying out transmission and reception of data such as signals appearing in FIG. 8 to and from the image sensor unit 60. The illumination control section (logic) 508 is an illumination light quantity control section that controls the quantity of illumination light from the LED 601 of the image sensor unit 601.

In the DSP 50, the sampling control section 501, image memory 503, speed computation processing section 505, filter processing section 505*a*, motor speed control section 506, and illumination control section 508 are configured to be programmable.

A description will now be given of the operation of the DSP 50.

The DSP 50 carries out the motor speed control process and the shift control process, described later. In the motor speed control process, the DSP 50 carries out the image comparison process on surface images of the intermediate transfer belt 31 sampled at intervals of predetermined sampling periods to compute the relative movement amount of the intermediate transfer belt 31, and, based on the computation result, controls the rotational speed of the transfer belt drive motor 56 so that the running speed of the intermediate transfer belt 31 can be equal to a predetermined target running speed. In the shift control process, the DSP 40 controls operation of the steering motor 81 of the alignment adjusting mechanism in FIG. 2 based on the computed relative movement amount to align the outside roller 80 so that the shift amount of the intermediate transfer belt 31 can be within a predetermined range. It should be noted that the relative movement amount means the amount of movement between sampling periods. The target running speed means the running speed of the intermediate transfer belt 31 set in advance in the image forming apparatus 1 and is, for example, the initial running speed of the intermediate transfer belt 31. The above-mentioned predetermined range of the shift amount is the shift amount of the intermediate transfer belt 31 within such a range as to present no problem in image formation. For example, the predetermined range of the shift amount is set in advance by experiments.

Referring first to FIGS. 10 to 13, a description will be given of how the relative movement amount of the intermediate transfer belt 31 is computed.

Figure 10:
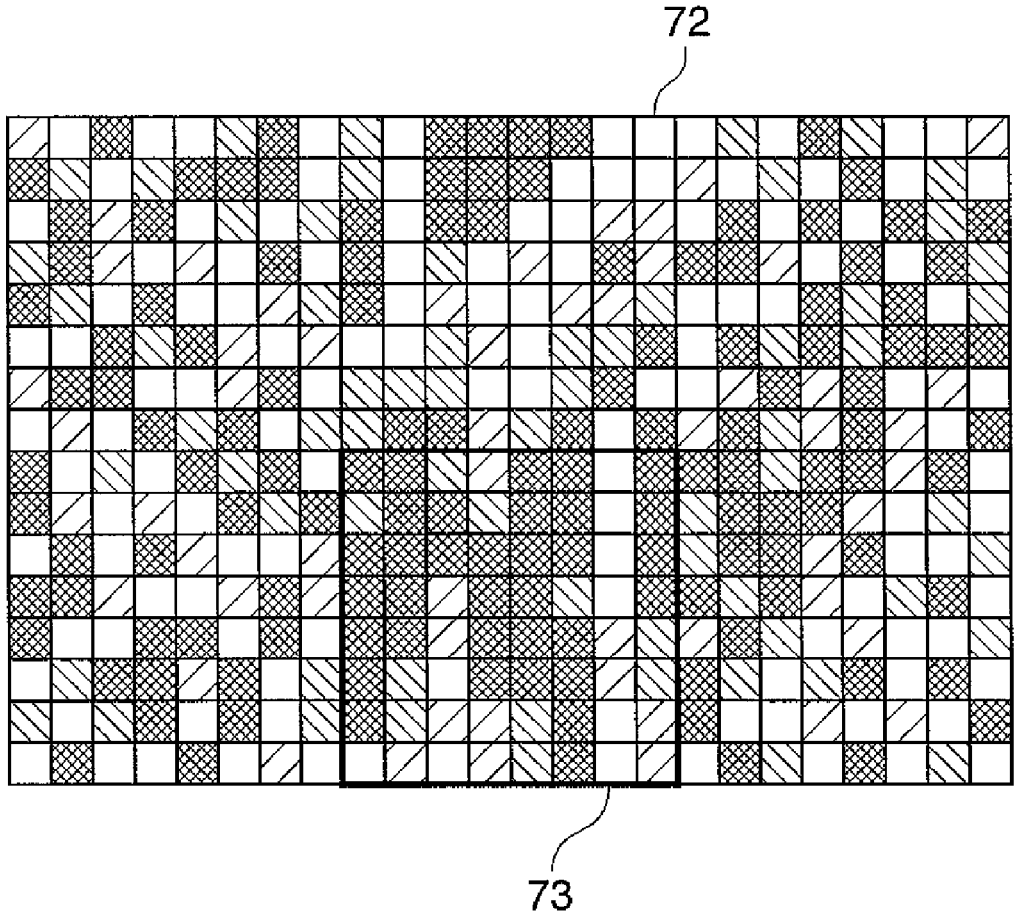
FIG. 10 is a diagram useful in explaining a method of detecting a surface image of the intermediate transfer belt using the image sensor unit in FIG. 7.

In the present embodiment, the CMOS sensor 602 reads a surface pattern of the intermediate transfer belt 31 to detect the surface image 72 of 24×16 pixels as shown in FIG. 10. As shown in FIG. 10, the sampling control section 501 then samples a predetermined area from the detected surface image 72, e.g. a surface image 73 of 8×8 pixels at the intervals of the above-mentioned sampling periods. The sampling control section 501 then creates shifted surface images by shifting the sampled surface image 73 on a pixel-by-pixel basis in a direction x in which transfer materials P are conveyed on the intermediate transfer belt 31 and a direction y perpendicular to the direction x (hereinafter also referred to as "the shift direction"). Then, in the next sampling period, the image comparison process in which the surface image from the CMOS sensor 602 sampled by the sampling control section 501 (see the surface image 73) and the shifted surface images created in the above-mentioned manner are compared with each other is carried out to compute the relative movement amount. Specifically, the relative movement of the intermediate transfer belt 31 is computed in a manner described below.

Figure 11A:
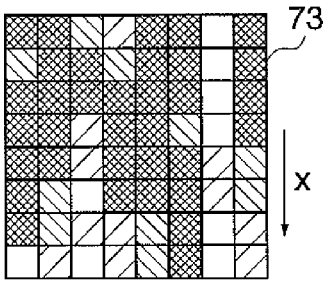
FIGS. 11A to 11I are diagrams showing examples of surface images of the intermediate transfer belt created by the image sensor unit in FIG. 5 and shifted surface images created by the DSP in FIG. 9.
Figure 11B:
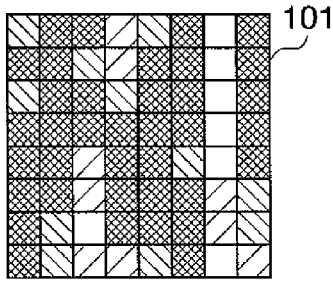
Figure 11F:
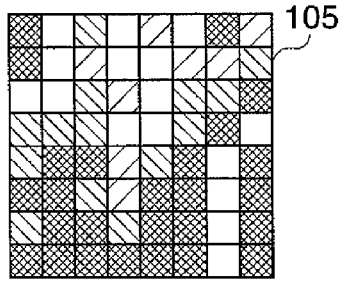
Figure 11C:
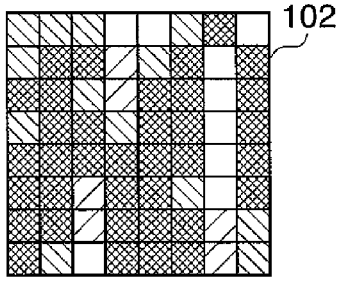
Figure 11G:
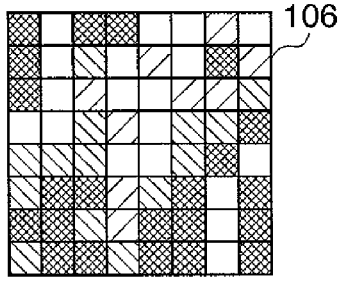
Figure 11D:
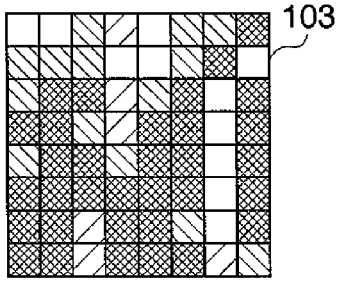
Figure 11H:
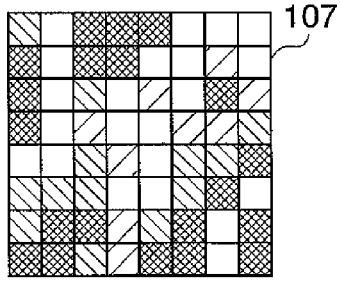
Figure 11E:
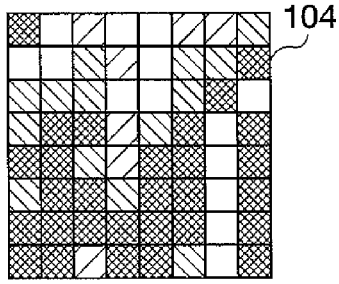
Figure 11I:
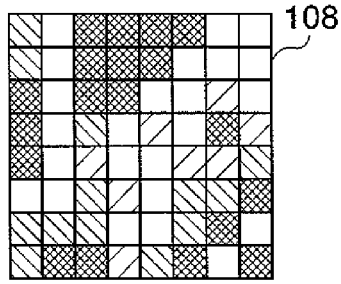
Figure 12A:
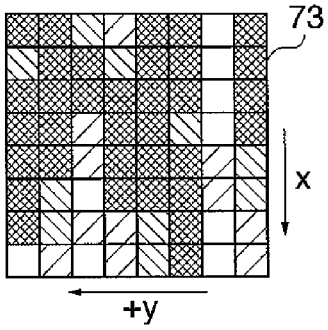
FIGS. 12A to 12I are diagrams showing examples of surface images of the intermediate transfer belt created by the image sensor unit in FIG. 5 and shifted surface images created by the DSP in FIG. 9.
Figure 12B:
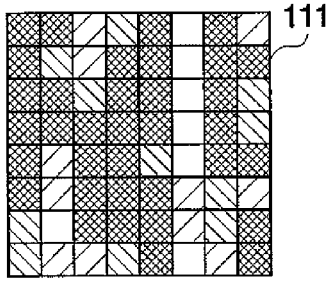
Figure 12F:
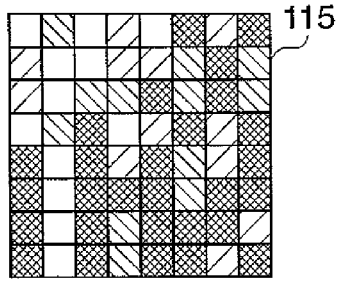
Figure 12C:
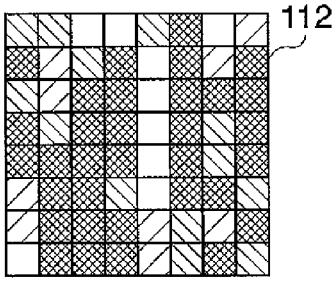
Figure 12G:
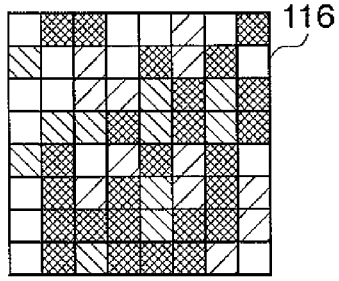
Figure 12D:
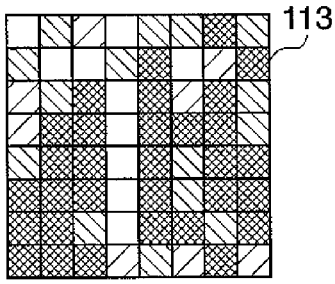
Figure 12H:
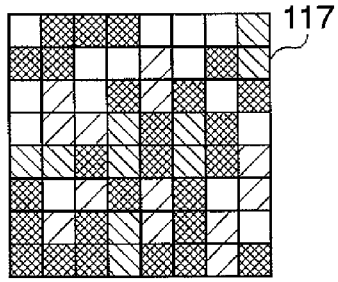
Figure 12E:
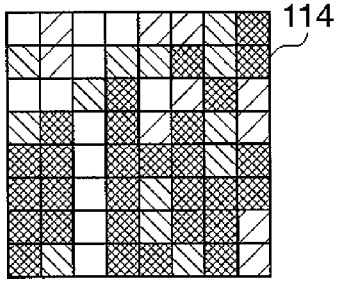
Figure 12I:
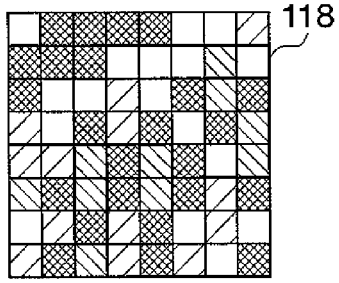
Figure 13A:
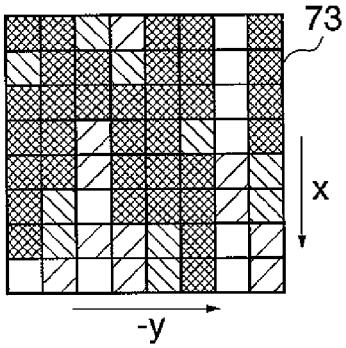
FIGS. 13A to 13I are diagrams showing examples of surface images of the intermediate transfer belt created by the image sensor unit in FIG. 5 and shifted surface images created by the DSP in FIG. 9.
Figure 13B:
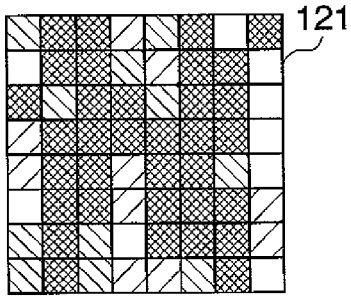
Figure 13F:
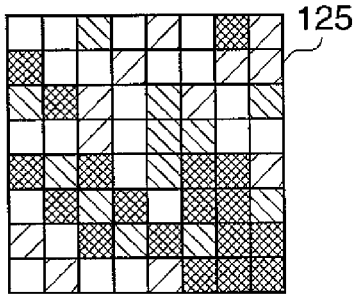
Figure 13C:
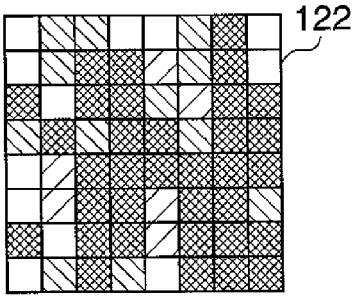
Figure 13G:
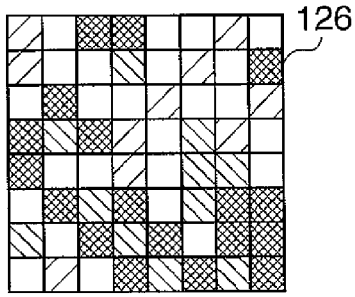
Figure 13D:
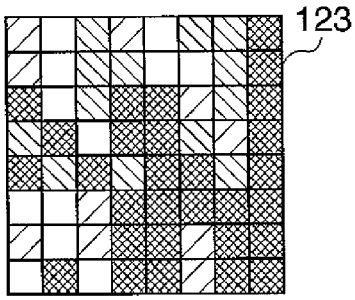
Figure 13H:
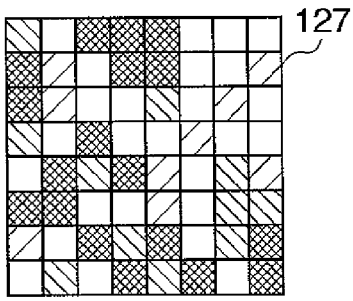
Figure 13E:
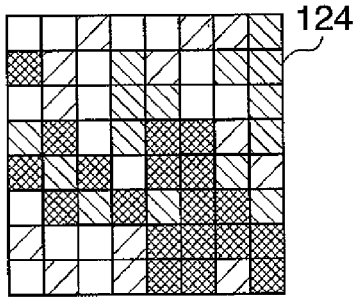
Figure 13I:
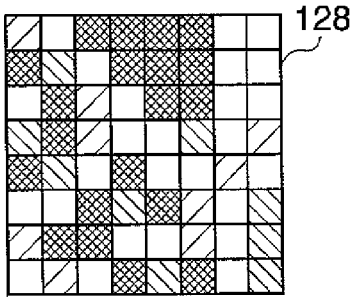

As shown in FIG. 11A, the CMOS sensor 602 reads a surface pattern of the intermediate transfer belt 31 to detect a surface image of 24×16 pixels (for example, the surface image 72) indicative of the read surface pattern. As described above with reference to FIG. 10, the sampling control section 501 then samples a surface image of 8×8 pixels (the surface image 73) from the created surface image 72 in a predetermined sampling period, captures the same into the image buffer 502, and stores the same as a reference image in the image memory 503. At this time, the sampling control section 501 creates shifted surface images (surface images 101 to 108) by shifting the sampled reference image 73 on a pixel-by-pixel basis in the direction x that is the conveying direction of the intermediate transfer belt 31 and stores the shifted surface images in the image memory 503 (see FIGS. 11B to 11I). That is, the shifted surface images 101 to 108 are images indicative of surface patterns at positions shifted in the conveying direction of the intermediate transfer belt 31 on a pixel-by-pixel basis from a position on the surface of the intermediate transfer belt 31 corresponding to the surface image 73. For example, the shifted surface image 101 is an image indicative of a surface pattern at a position shifted one pixel in the conveying direction, and the shifted surface image 108 is an image indicative of a surface pattern at a position shifted eight pixels in the conveying direction.

As shown in FIGS. 12A to 12I and 13A to 13I, the sampling control section 501 also creates shifted surface images 111 to 118 and 121 to 128 by shifting the sampled reference image 73 on a pixel-by-pixel basis in both the direction x and the direction y perpendicular to the conveying direction (direction x) and stores the created shifted surface images in the image memory 503. That is, the shifted surface images 111 to 118 are images indicative of surface patterns at positions shifted in both the direction x and the direction +y (toward the front) on a pixel-by-pixel basis from the position on the surface of the intermediate transfer belt 31 corresponding to the surface image 73. Also, the shifted surface images 121 to 128 are images indicative of surface patterns at positions shifted in both the direction x and the direction −y (toward the rear) on a pixel-by-pixel basis from the position on the surface of the intermediate transfer belt 31 corresponding to the surface image 73. For example, the shifted surface image 111 is an image indicative of a surface pattern at a position shifted one pixel in the conveying direction and one pixel toward the front in the shift direction, the shifted surface image 118 is an image indicative of a surface pattern at a position shifted eight pixels in the conveying direction and eight pixels toward the front in the shift direction, the shifted surface image 121 is an image indicative of a surface pattern at a position shifted one pixel in the conveying direction and one pixel toward the rear in the shift direction, and the shifted surface image 128 is an image indicative of a surface pattern at a position shifted eight pixels in the conveying direction and eight pixels toward the rear in the shift direction.

The creation of shifted surface images described above aims to detect the amount of relative movement in the two directions, i.e. the conveying direction and the shift direction of the intermediate transfer belt 31 by creating images shifted on a pixel-by-pixel basis in the two directions, i.e. the conveying direction and the shift direction. It should be noted that the intermediate transfer belt 31 may shift toward the front or rear of the image forming apparatus 1, and accordingly, shifted surface images are created by shifting in the direction +y toward the front and the direction −y toward the rear. Specifically, the sifted surface images 111 to 118 shifted on a pixel-by-pixel basis in each of the direction x and the direction +y as shown in FIGS. 12B to 12I and the sifted surface images 121 to 128 shifted on a pixel-by-pixel basis in each of the direction x and the direction −y as shown in FIGS. 13B to 13I are created.

The image comparison processing section 504 then carries out the image comparison process. Specifically, a surface image from the CMOS sensor 602 which has been newly sampled by the sampling control section 501 is compared with the reference image (surface image 73) and the shifted surface images (surface images 101 to 108, 111 to 118, and 121 to 128) stored in the image memory 503 to search for an image matching the newly sampled surface image. In the image comparison process, if any image does not completely match the sampled surface image but partially matches the sampled surface image at not less than a predetermined percentage, it can be determined that they match each other. It is then derived how many pixels the image matching the sampled surface image has been shifted from the reference image 73. Accordingly, the created shifted surface images are stored together with information indicative of how many pixels they have been shifted in the directions x and y from the reference image (hereinafter referred to as "the number of pixel shifts") in the image memory 503.

Next, the speed computation processing section 505 carries out a computation process based on the result of the image comparison process. In the computation process, assuming that the sampled image matches an image shifted 5 pixels in the direction x from the reference image (see FIG. 11F), it is determined by computation that the intermediate transfer belt 31 has moved 50 μm if the size of one pixel is 10 μm. Also, assuming that the sampling period is 1 kHz, a relative speed of 0.05×1 kHz=50 mm/sec relative to the running speed of the intermediate transfer belt 31 at the time of the previous sampling is determined by computation.

Similarly, with respect to the direction y, assuming that the sampled image matches an image shifted 5 pixels in the direction +y, which is perpendicular to the conveying direction, from the reference image (see FIG. 12F), it is determined by computation that the intermediate transfer belt 31 has moved toward the front 50 μm if the size of one pixel is 10 μm. Also, assuming that the sampled image matches an image shifted 5 pixels in the direction −y from the reference image (see FIG. 12F), it is determined by computation that the intermediate transfer belt 31 has moved 50 μm toward the rear if the size of one pixel is 10 μm. The shift amount can be computed from the movement amount thus computed.

Specifically, in the present embodiment, in the DSP 50, the sampling control section 501 samples surface images of the intermediate transfer belt 31 read from the CMOS sensor 602 at intervals of predetermined sampling periods. The sampling control section 501 then captures the sampled surface image into the internal buffer 502 and stores the same as a reference image in the image memory 503. The image comparison processing section 504 then reads out the sampled surface image, a reference image sampled in advance in the previous sampling period, and shifted surface images created based on the reference image from the image memory 503 and sequentially carries out comparison operations in the image comparison process. The speed computation processing section 505 then detects the amount of image shift in the conveying direction and the shift direction of the intermediate transfer belt 31 from the image comparison result and computes the relative movement amount by deriving how many pixels the reference image sampled in the previous sampling period has shifted in the conveying direction and the shift direction at the time of the next sampling. The speed computation processing section 505 then computes the relative speed of the intermediate transfer belt 31 and the shift amount of the intermediate transfer belt 31 in the shift direction from the computed relative movement amount and the sampling period.

Based on the computation result, the motor speed control section 506 then computes the speed to which the motor is controlled and carries out servo control in the motor speed control process as will be described later. Further, in the shift control process, the motor speed control section 506 transmits drive pulses corresponding in number to the number of steps corresponding to the shift amount of the intermediate transfer belt 31 to rotate the steering motor 81, whereby the position of the intermediate transfer belt 31 in the shift direction is controlled to be within a predetermined range.

It should be noted that the relative speed and the shift amount of the intermediate transfer belt 31 derived by the above described computation process includes a detection noise and/or a computation error, and hence they are subjected to filtering by the filter processing section 505*a* so that a speed suitable for servo control of the motor and drive pulses suitable for controlling the stepping motor can be derived. For example, if the relative speed of the intermediate transfer belt 31 is an abruptly changing value due to a detection noise, the speed to which the servomotor is controlled abruptly changes, which may cause image degradation. Further, in the shift control process, if the shift amount of the intermediate transfer belt 31 is an abruptly changing value, the number of drive pulses for driving the stepping motor may abruptly change, which may cause loss of synchronism of the motor.

To avoid such problems, the filter processing section 505*a* carries out filtering on the relative speed detected as mentioned above, and the motor speed control section 506 computes the speed to which the servomotor is controlled. Similarly, in the shift control process, after the filter processing section 505*a* carries out filtering on the shift amount, the motor speed control section 506 transmits drive pulses corresponding in number to the number of steps corresponding to the shift amount, whereby the stepping motor is controlled in the optimum manner.

Figure 14:
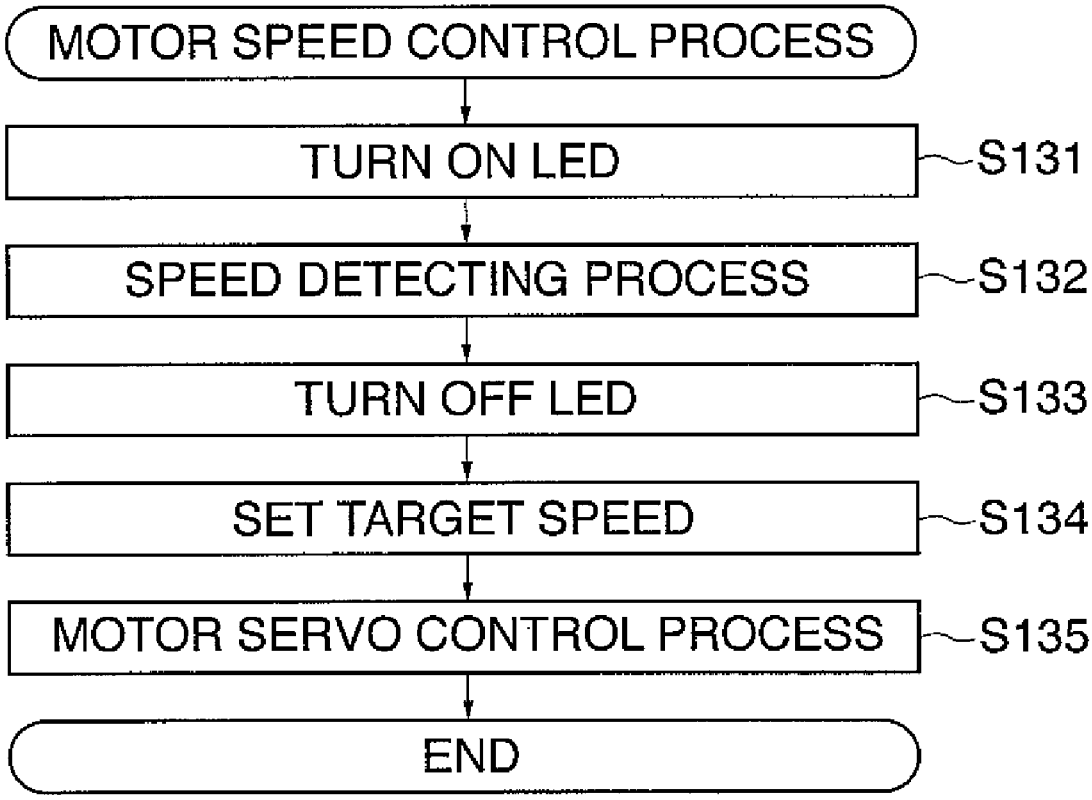
FIG. 14 is a flow chart of a motor speed control process carried out by the DSP in FIG. 9.

Referring next to FIG. 14, a description will be given of the motor speed control process for the intermediate transfer belt 31, which is carried out by the DSP 50. FIG. 14 is a flow chart of the motor speed control process carried out by the DSP 50. In the motor speed control process, a speed detecting process and a motor servo control process are carried out.

Upon the start of the motor speed control process, first, the DSP 50 causes the LED 601 to light up and irradiate LED light onto the surface of the intermediate transfer belt 31 (step S131). Next, the DSP 50 carries out the speed detecting process (step S132), described later with reference to FIG. 15. After carrying out the speed detecting process, the DSP 50 turn off the LED 601 (step S133) and sets a target speed of the transfer belt drive motor 56 (step S134). In the step S134, the target speed of the transfer belt drive motor 56 is set so that the running speed of the intermediate transfer belt 31 can become equal to a target running speed and be kept at this speed in accordance with the average relative speed of the intermediate transfer belt 31 computed in the speed detecting process. In the step S134, the target speed of the transfer belt drive motor 56 is set by the speed computation processing section 505. The motor servo control process for the transfer belt drive motor 56 is then carried out (step S135), described later with reference to FIG. 16, followed by termination of the process.

Figure 15:
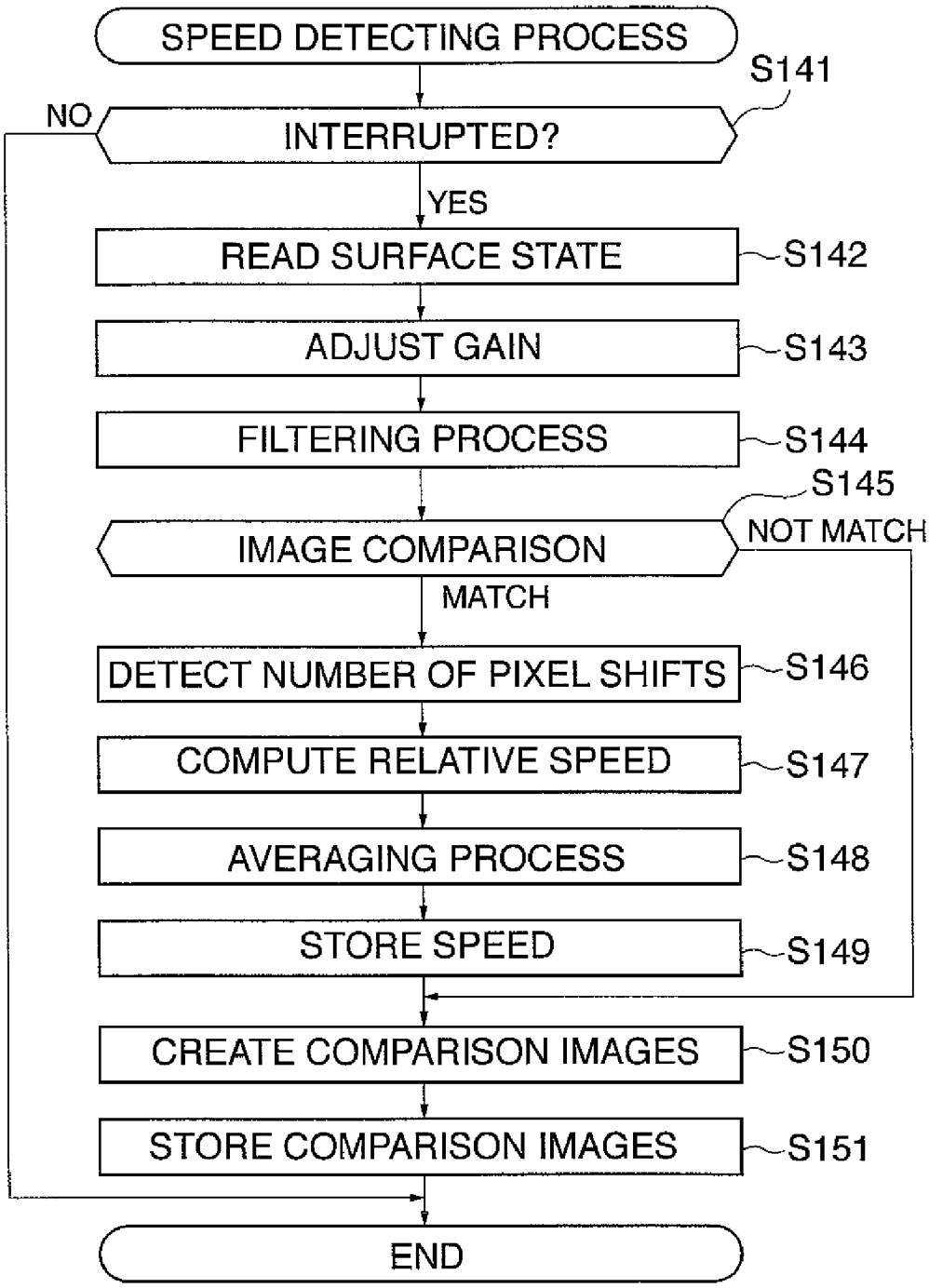
FIG. 15 is a flow chart of a motor speed control process carried out in the motor speed control process in FIG. 14.
Figure 16:
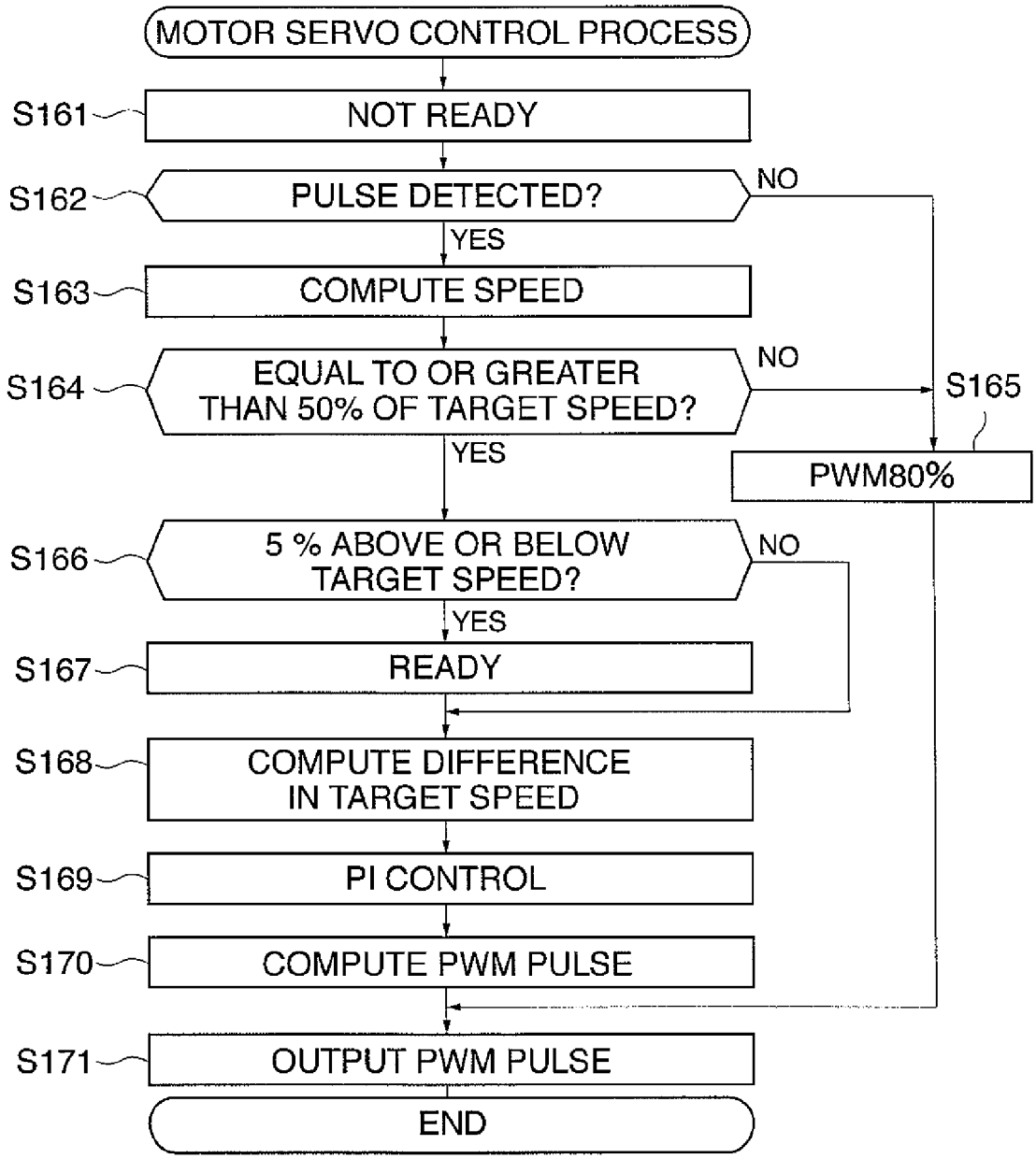
FIG. 16 is a flow chart of a motor servo control process carried out in the motor speed control process in FIG. 14.

Next, a description will be given of the speed detecting process in which the speed of the transfer belt drive motor 56 is detected in the step S132 of the motor speed control process in FIG. 14. FIG. 15 is a flow chart of the speed detecting process carried out in the step 3132 of the motor speed control process.

First, an interrupt signal for determining a sampling period (for example, 1 ms) based on the clock signal S2 is monitored (step S141). If the interrupt signal is not received, the present process is terminated. On the other hand, if the interrupt signal received, the CMOS sensor 602 reads a surface pattern of the intermediate transfer belt 31 upon receipt of the interrupt signal to create a surface image (for example, the image 72 in FIG. 10) (step S142). The surface image (image data) created in the step S142 is then analog-to-digital converted by the A/D converter 612, and the gain of the filter circuit 613 is adjusted so that the optimum surface image can be created from the surface pattern detected by the CMOS sensor 602 (step S143). Next, the filter circuit 613 carries out filtering on the analog-to-digital converted surface image (step S144). In the filtering, 8-bit and 256-tone data detected by the CMOS sensor 602 converted into 16-tone data, and components such as noise are removed from the detected data. The sampling control section 501 then samples the filtered surface image.

Next, the image comparison process in which the sampled image sampled by the sampling control section 501 (see the image 73 in FIG. 10) is compared with comparison images stored in advance in the image memory 503 in the previous processing is carried out to determine whether or not any of the comparison images matches the sampled image (step S145). The comparison images correspond to the above-mentioned reference image 73, shifted surface images 101 to 108, 111 to 118, and 121 to 128 (see FIGS. 11A to 11I, FIGS. 12A to 12I, and FIGS. 13A to 13I). If no comparison image matches the sampled image, the process proceeds to a step S150). On the other hand, if any comparison image matches the sampled image, the number of pixel shifts of the comparison image in the direction x is detected from the image memory 503 (step S146). A computation process is then carried out to compute the relative speed of the intermediate transfer belt 31 based on the above-mentioned predetermined sampling period and the number of pixel shifts detected in the step S146 (step S147).

Next, averaging of the relative speeds of the intermediate transfer belt 31 computed in the step S147 during a time period set in advance is carried out to compute the average relative speed of the intermediate transfer belt 31 (step S148). The computed average relative speed is stored in the image memory 503 (step S149).

Next, comparison images for use in the step S145 of the next speed detecting process are created from the sampled image created in the present speed detecting process (step S150), and the created comparison images are stored in the image memory 503, followed by termination of the speed detecting process.

Next, a description will be given of the motor servo control process carried out in the step 3135 of the motor speed control process in FIG. 14. FIG. 15 is a flow chart of the motor servo control process carried out in the step S135 of the motor speed control process in FIG. 14. The motor servo control process is a process in which the speed of the transfer belt drive motor 56 is servo-controlled to a predetermined target speed based on the average relative speed of the intermediate transfer belt 31 computed in the speed detecting process in FIG. 15.

The motor servo control process is carried out after the DSP 50 transmits the starting command 411 (see FIG. 3) to the transfer belt drive motor 56. First, a flag indicative of a NOT-READY state in which the speed of the transfer belt drive motor 56 has not yet reached the target speed is set (step S161), and speed pulses are monitored (step S162). Monitoring of the speed pulses in the step S162 is carried out by detecting edges of the speed detection signal 413 appearing in FIG. 4.

Next, the rotational speed of the transfer belt drive motor 56 is computed (step S163). This computation is carried out by the speed computation processing section 505. For example, if the speed detecting signal 413 with 30 pulses is output during one turn of the transfer belt drive motor 56 and the speed detecting signal 413 has a pulse width of t sec, the rotational speed ω of the transfer belt drive motor 56 can be expressed by the following equation, $\omega=2\pi/30/t$ (rad/sec).

Next, it is determined whether or not the rotational speed ω of the transfer belt drive motor 56 computed in the step S163 is equal to or greater than 50% of the target speed set in the step S134 of the motor speed control process in FTC 14 (step S164).

It the rotational speed ω is less than 50% of the target speed, the ON duty of the PWM is set to 80% (step S165), and a PWM pulse with the set ON duty output to the transfer belt drive motor 56 (step S171), followed by termination of the present process.

On the other hand, if the rotational speed ω equal to or greater than 50% of the target speed, it is further determined whether or not the rotational speed ω is 5% above or below the target speed (step S166). If the rotational speed ω is 5% above or below the target speed, a READY flag indicative of a state in which the rotational speed of the transfer belt drive motor 56 has reached the target speed is set (step S167), and the process proceeds to a step S168. On the other hand, if the rotational speed ω is not 5% above or below the target speed, the process proceeds directly to the step S168.

In the step S168, a difference between the target speed of the transfer belt drive motor 56 and the actual rotational speed ω is computed. Next, PI computation (control) is carried out on the computed difference (step S169), and based on the computation result, a PWM pulse width according to which a difference between the target speed of the transfer belt drive motor 56 and the actual rotational speed ω can be 0 is determined (step S170), and a PWM pulse with the computed pulse width is output to the transfer belt drive motor 56 (step S171), followed by termination of the present process.

By the sequence of steps in the above described motor speed control process, power supplied to the transfer belt drive motor 56 (three-phase DC motor 404) is controlled in accordance with the output PWM pulse in the DC motor unit 401 appearing in FIG. 4. As a consequence, the transfer belt drive motor 56 is servo-controlled so that the rotational speed thereof can follow the target speed.

Figure 17:
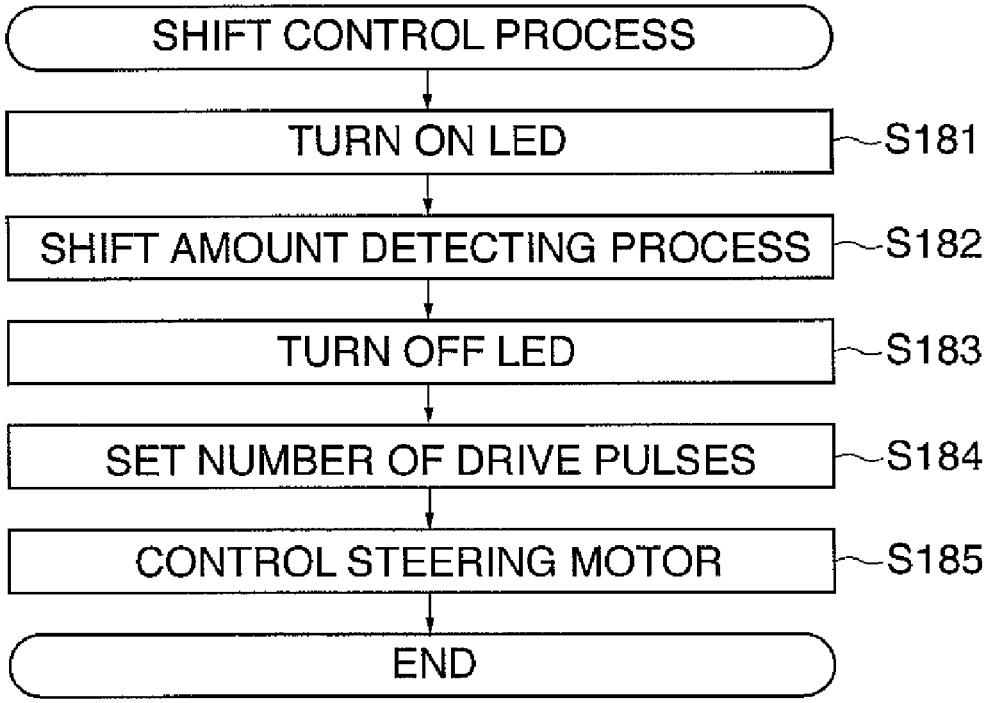
FIG. 17 is a flow chart of an intermediate transfer belt shift control process carried out by the DSP in FIG. 9

Referring next to FIG. 17, a description will be given of the shift control process for the intermediate transfer belt 31, which is carried out by the DSP 50. FIG. 17 is a flow chart of the shift control process for the intermediate transfer belt 31, which is carried out by the DSP 50.

Upon the start of the shift control process, first, the DSP 50 causes the LED 601 to light up and irradiate LED light onto the surface of the intermediate transfer belt 31 (step S181) and then carries out a shift amount detecting process (step S182), described later with reference to FIG. 19.

After completing the shift amount detecting process, the DSP 50 turns off the LED 601 (step S183) and sets the number of pulses for driving the steering motor 81 (step S184). Specifically, the number of pulses for driving the steering motor 81 is set so that the shift amount of the intermediate transfer belt 31 computed in the shift amount detecting process in the step S182 can be within the above-mentioned predetermined range. The drive pulses set in the step S184 are then output to the steering motor driver 67 to drive the steering motor 81 (step S185). As a consequence, the shift amount of the intermediate transfer belt can be kept within the above-mentioned predetermined range by the alignment adjusting mechanism.

Figure 18:
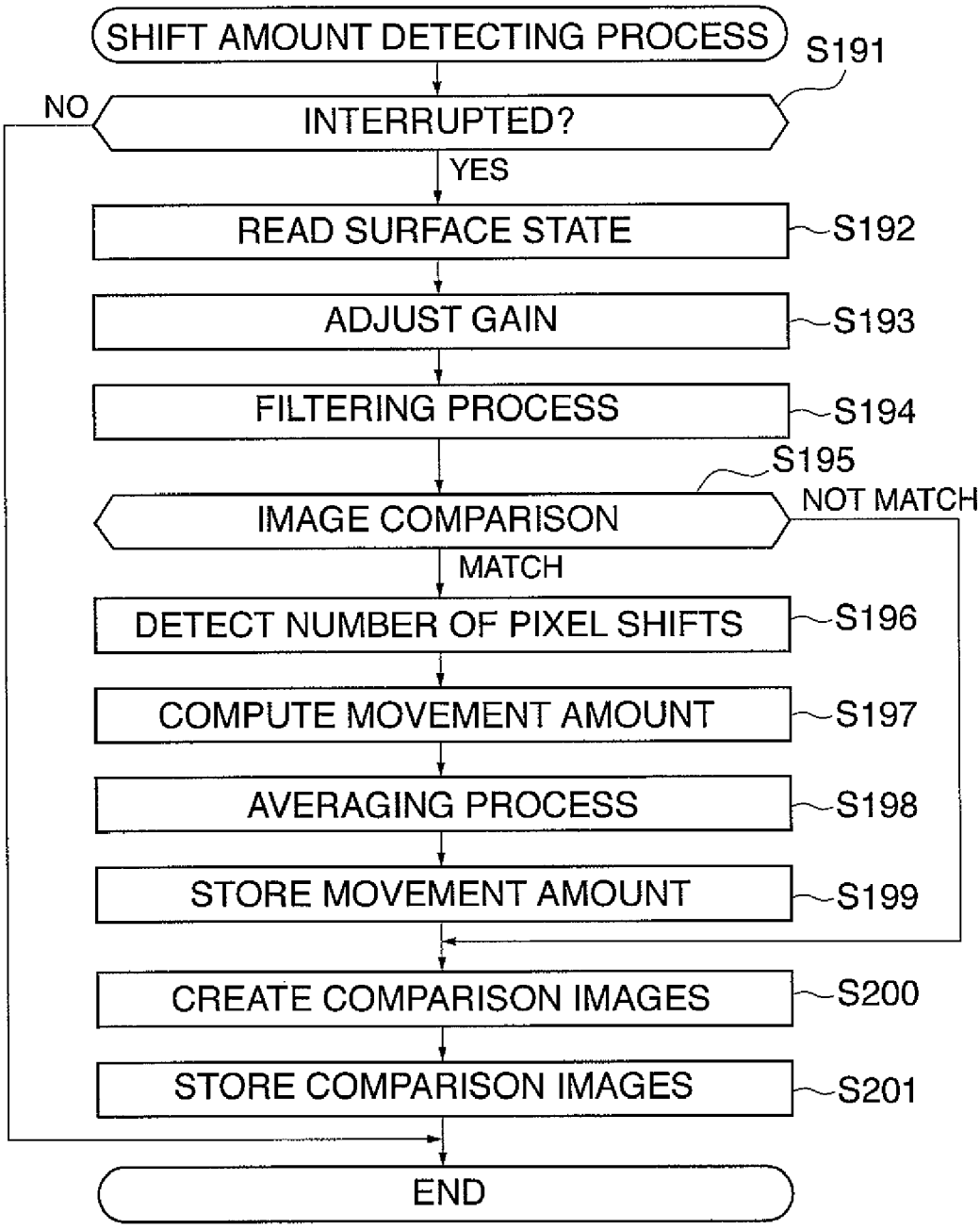
FIG. 18 is a flow chart of a shift amount detecting process carried out in the shift control process in FIG. 17.

Next, a description will be given of the shift amount detecting process carried out in the step S182 of the shift control process in FIG. 17. FIG. 18 is a flow chart of the shift amount detecting process carried out in the step S182 of the shift control process in FIG. 17.

In the shift amount detecting process, first, an interrupt signal for determining a predetermined sampling period (for example, 1 ms) set in advance based on the clock signal S2 is monitored (step S191), and if the interrupt signal is not received, the present process is terminated. On the other hand, if the interrupt signal is received, the CMOS sensor 602 reads a surface pattern of the intermediate transfer belt 31 to create a surface image (for example, the surface image 72 in FIG. 10) (step S192). The surface image (image data) created in the step S192 is then analog-to-digital converted by the A/D converter 612, and the gain of the filter circuit 613 is adjusted so that the optimum surface image can be created from the surface pattern detected by the CMOS sensor 602 (step S193). Next, the filter circuit 613 carries out filtering on the analog-to-digital converted surface image (step S194). In the filtering, 8-bit and 256-tone data detected by the CMOS sensor 602 is converted into 16-tone data, and components such as noise are removed from the detected data. The sampling control section 501 then samples the filtered surface image.

Next, the image comparison process in which the sampled image (see the image 73 in FIG. 10) sampled by the sampling control section 501 is compared with comparison images stored in advance in the image memory 503 in the previous processing is carried out to determine whether or not any of the comparison images matches the sampled image (step S195). The comparison images correspond to the above-mentioned reference image 73, shifted surface images 101 to 108, 111 to 118, and 121 to 128 (see FIGS. 11A to 11I, 12A to 12I, and 13A to 13I). If no comparison image matches the sampled image, the process proceeds to a step S200. On the other hand, if any comparison image matches the sampled image, the number of pixel shifts of the comparison image in the directions x and y is detected from the image memory 503 (step S196). A computation process is then carried out to compute the shift amount (movement amount) of the intermediate transfer belt 31 based on the above-mentioned predetermined sampling period and the number of pixel shifts detected in the step S196 (step S197).

Next, averaging of the shift amounts of the intermediate transfer belt 31 computed in the step S197 during a time period set in advance is carried out to compute the average shift amount of the intermediate transfer belt 31 (step S198). The computed average shift amount is stored in the image memory 503 (step S199).

Next, comparison images for use in the step S195 of the next shift amount detecting process is created from the sampled image created in the present shift amount detecting process (step S200), and the created comparison images are stored in the image memory 503 (step S201), followed by termination of the shift amount detecting process.

As described above, the image forming apparatus 1 according to the first embodiment of the present invention uses the CMOS sensor 602 to detect a surface pattern of the intermediate transfer belt 31 in a predetermined sampling period to create a sampled image indicative of the surface pattern. The DSP 50 then compares the sampled image created in the present sampling period with surface images (reference image and shifted surface images) of the intermediate transfer belt 31 created in advance based on a sampled image created in the previous sampling period and computes the relative speed and shift amount of the intermediate transfer belt 31 based on the comparison result. The DSP 50 then servo-controls the intermediate transfer belt drive motor 56 so that the computed relative speed can be 0, that is, the rotational speed of the intermediate transfer belt drive motor 56 can be equal to a target speed. The DSP 50 also drives the steering motor 81 to adjust the position of the intermediate transfer belt 31 in the shift direction so that the computed shift amount of the intermediate transfer belt 31 can be within a predetermined range. Thus, the rotational speed of the intermediate transfer belt drive motor 56 can be controlled to the target speed by servo control mentioned above even when the intermediate transfer belt drive motor 56 expands due to increased temperature in the apparatus. For this reason, the running speed of the intermediate transfer belt 31 can be controlled to a fixed speed (target running speed), so that color shift and image blurring caused by increased temperature in the apparatus can be reduced, and therefore high-quality images can be obtained. Additionally, since the shift of the intermediate transfer belt 31 is controlled, color shift and image blurring can be further reduced, and therefore higher-quality images can be obtained.

It should be noted that although in the present embodiment, the image sensor unit 60 is disposed in the vicinity of the photosensitive drum 11*a*, but it goes without saying that the location of the image sensor unit 60 is not limited to this, but the image sensor 60 may be disposed at any location insofar as it can obtain surface images of the intermediate transfer belt 31. Also, although in the present embodiment, the DC motor drives the intermediate transfer belt 31, this is not limitative, but for example, a stepping motor may drive the intermediate transfer belt 31.

Also, although in the present embodiment, the CMOS sensor 602 has 24×16 pixels, the configuration of the CMOS sensor 602 is not limited to this. Also, although in the present embodiment, the DSP 50 creates the shifted surface images 101 to 108, 111 to 118, and 121 to 128 shifted 1 to 8 pixels in each direction as shifted surface images, the number of pixels they are shifted should not necessarily be 1 to 8.

It should be noted that although in the motor speed control process described above, the target speed and rotational speed of the transfer belt drive motor 56 are computed based on the average relative speed computed in the speed detecting process, the target speed and rotational speed of the transfer belt drive motor 56 may be computed based on the relative speed computed in the speed detecting process. Similarly, in the shift control process, a PWM pulse signal to be output to the steering motor 81 may be computed based on the shift amount computed in the shift amount detecting process. This can simplify the speed detecting process and the shift amount detecting process.

Next, a description will be given of an image forming apparatus according to a second embodiment of the present invention. The image forming apparatus according to the second embodiment is an image forming apparatus having no intermediate transfer member. In the following description, component elements corresponding to those of the image forming apparatus 1 according to the first embodiment described above are denoted by the same reference numerals, and therefore description thereof is omitted. Only points of differences will be described below.

Figure 19:
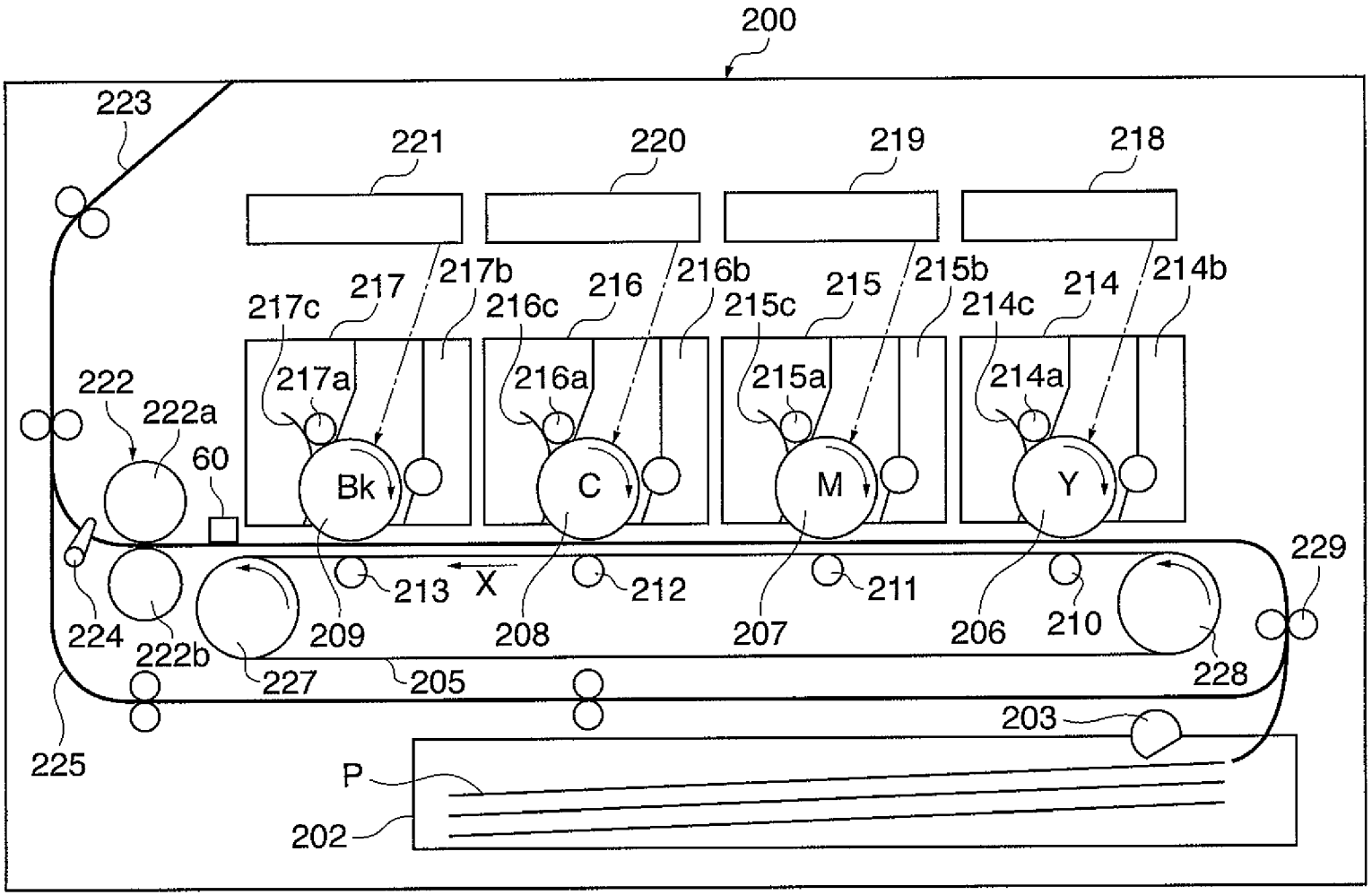
FIG. 19 is a sectional view schematically showing the essential parts of an image forming apparatus according to a second embodiment of the present invention.

FIG. 19 is a sectional view schematically showing the construction of the essential parts of the image forming apparatus 200 according to the present embodiment. The image forming apparatus 200 is comprised of a transfer belt 205 as a transfer material bearing belt that carries and conveys transfer materials P. Along a transfer material bearing surface of the transfer belt 205, process cartridges (hereinafter merely referred to as "the cartridges") 214, 215, 216, and 217 for yellow (Y), magenta (M), cyan (C), and black (Bk), respectively, are arranged in tandem. Above the respective cartridges 214 to 217, scanner units 218, 219, 220, and 221 are arranged in association with the respective cartridges 214 to 217. Further, transfer rollers 210, 211, 212, and 213 associated with respective photosensitive drums 206, 207, 208, and 209 in the respective cartridges 214 to 217 are arranged below the respective cartridges 214 to 217 with the transfer belt 205 interposed therebetween. The cartridges 214 to 217 are provided with electrostatic charging rollers 214*a*, 215*a*, 216*a*, and 217*a*, developing devices 214*b*, 215*b*, 216*b*, and 217*b*, and cleaners 214*c*, 215*c*, 216*c*, and 217*c*, respectively, which are arranged around the photosensitive drums 206 to 209.

The transfer belt 205 is wound on a transfer belt drive roller 227 and a driven roller 228 and moves in a direction indicated by an arrow in FIG. 19 with rotation of the transfer belt drive roller 227.

With the above arrangement, yellow, magenta, cyan, and black toner images obtained by a known electrophotographic process are transferred in a manner being superposed on a transfer material P fed from a sheet cassette 202 to the transfer belt 205 by a pickup roller 203 and a sheet feed and conveying roller pair 229. The toner images transferred onto the transfer material P are fixed by a fixing device 222 and discharged from the apparatus via a discharged sheet sensor 224 and a sheet path 223. It should be noted that the fixing device 222 is comprised mainly of a fixing roller 222*a* having a heater incorporated therein, and a pressurizing roller 222*b*.

To form toner images on the reverse side of the transfer material P as well, the transfer material P is conveyed to the transfer belt 205 again via another sheet path 225 after having passed through the fixing device 222, so that toner images are formed on the reverse side of the transfer material P in the same manner as the above described manner.

In the image forming apparatus 200, an image sensor unit 60 that is a reading unit is disposed in the vicinity of the cartridge 217 for black in the lowermost stream side and the transfer belt 205 and in opposed relation to the transfer belt 205. The image sensor unit 60 irradiates light onto the surface of the transfer belt 205 or a transfer material P and gathers reflected light from the surface of the transfer belt 205 or the transfer material P to form an image, to thereby detect a surface image indicative of a surface pattern in a specific area on the transfer belt 205 or the transfer material P. The image sensor unit 60 is identical in construction with the image sensor unit 60 according to the first embodiment. It should be noted that the reason why the image sensor unit 60 is disposed downstream in the transfer material conveying direction, that is, on the fixing device 222 side is that the transfer belt drive roller 227 is most susceptible to heat. That is, since the diameter of the transfer belt drive roller 227 is most likely to expand due to heat in the apparatus, a change in the circumferential velocity of the transfer belt 205 caused by the expansion has to be detected as soon as possible.

In the image forming apparatus 200 constructed as described above and having no intermediate transfer member, the motor speed control process (FIGS. 14 to 16) and the shift control process (FIGS. 17 and 18) are carried out as described earlier in the description of the first embodiment. Specifically, the image sensor unit 60 provided with the CMOS sensor 602 and disposed in opposed relation to the transfer belt 205 creates a surface image of the transfer belt 205. The DSP 50 then determines the relative speed of the transfer belt 205 in the conveying direction and the amount of movement in the shift direction perpendicular to the conveying direction from the created surface image. The transfer belt drive motor is then servo-controlled according to the determined relative speed of the transfer belt 205 in the conveying direction, so that the running speed of the transfer belt 205 is constantly controlled to a fixed target running speed. Also, the steering motor of the alignment adjusting mechanism is controlled according to the obtained running speed of the transfer belt 205, so that the shift of the transfer belt 205 is controlled so that the shift amount of the transfer belt 205 can be within a predetermined range. Thus, in the image forming apparatus 200 having no intermediate transfer member, color shift and image blurring caused by increased temperature in the apparatus can be reduced, and therefore high-quality images can be obtained.

It should be noted that the motor speed control process and the shift control process are identical with those in the first embodiment, and therefore description thereof is omitted.

Next, a description will be given of an image forming apparatus according to a third embodiment of the present invention.

The image forming apparatus according to the third embodiment differs from the image forming apparatus according to the first embodiment described above in the motor speed control process and the movement control process. Specifically, the relative speed and shift amount of the intermediate transfer belt are not computed using pattern matching of images as in the first embodiment described above, but are computed using a centroid computation method. In the following description, component elements corresponding to those in the first embodiment described above are denoted by the same reference numerals and description thereof is omitted. Only points of differences will be described below.

Figure 20A:
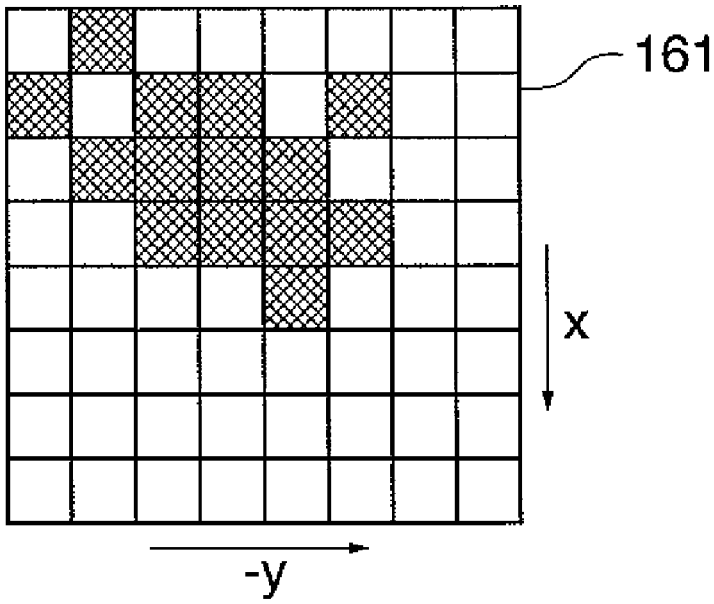
FIGS. 20A and 20B are diagrams showing respective surface images obtained as a result of binarization of surface images of the intermediate transfer belt read by a CMOS sensor appearing in FIG. 5.
Figure 20B:
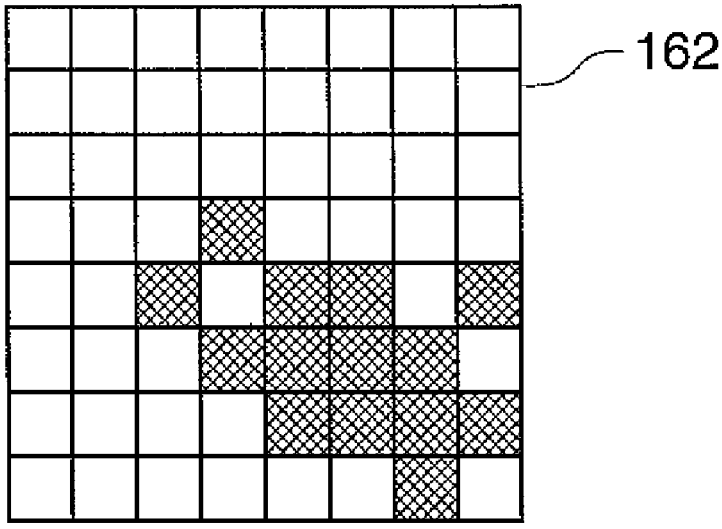

FIGS. 20A and 20B are diagrams showing respective surface images 161 and 162 obtained as a result of binarization of surface images of the intermediate transfer belt 31 read by the CMOS sensor 602. FIGS. 21A and 21B are views of tables 163 and 164 showing the results of centroid computations based on the respective binarized images in FIGS. 20A and 20B.

In the present embodiment, the image comparison processing section 504 of the DSP 50 binarizes the surface image 73 (see FIG. 10), which is a part of the surface image 72 of the intermediate transfer belt 31 read by the CMOS sensor 602, based on a predetermined threshold value. The image comparison processing section 504 then computes centroids in the directions x and y based on the binarized images. A concrete description will now be given of how centroids in the directions x and y are computed.

For example, coefficients as shown in the table 163 (FIG. 21A) are assigned to the binarized surface image 161 (FIG. 20A) in the directions x and y. In the present embodiment, coefficients 7, 6, . . . 0, 1 are assigned to respective rows of an image of 8×3 pixels in order from the top row as shown in FIG. 21A. Similarly, coefficients 7, 6, . . . , 1, 0 are assigned to respective columns of the image in order from the left. Next, binarized data of the binarized surface image 161 are given in the rows and columns of the table 163. Specifically, binarized data "1" are given in fields of the table 163 corresponding to pixels with higher densities than the above-mentioned threshold value in the binarized surface image 161, and binarized data "0" are given in fields of the table 163 corresponding to pixels with lower densities than the above-mentioned threshold value.

How many pixels with higher densities exist in each of the rows and the columns is then determined. That is, the sum of the binarized data given in each of the rows and the columns is computed. In the table 163 of FIG. 21A, for example, the number of pixels with higher densities is 1 in the column with the coefficient 7; 2 in the column with the coefficient 6; 1 in the row with the coefficient 3; and 4 in the row with the coefficient 4. Next, based on the computed numbers of pixels, partial sums are computed with respect to all of the rows and columns. For example, partial sums are computed as follows: 7×1=7 in the column with the coefficient 7 since the number of pixels with high densities is 1, 6×2=7 in the column with the coefficient 6, 3×1=3 in the row with the coefficient 3, and 4×4=16 in the row with the coefficient 4.

The partial sums in the rows and the columns are then totaled. In the table 163, the sum of the partial sums in the rows is 70, and the sum of the partial sums in the columns is 59. These partial sums are then divided by the number of pixels with higher densities, resulting in centroids. In the table 163, the centroid in the direction x is expressed by the following equation, 70÷14=5, and the centroid in the direction y is expressed by the following equation, 59÷14=4.21.

Thereafter, in the next sampling period, the CMOS sensor 602 samples a surface image of the intermediate transfer belt 31 to create a surface image, and the binarized surface image 162 (FIG. 208) is created by carrying out binarization in a manner similar to the above described manner. Centroids are then computed in a manner similar to the above-described manner. In this case, the centroids of the surface image 162 sampled next are computed as follows: the centroid in the direction x is 2, and the centroid in the direction y is 2.21.

The table 163 and the table 164 are then compared with each other, i.e. the computed centroids in the directions x and y are compared with each other, so that the amounts of relative movement of the intermediate transfer belt 31 in the directions x and y from one sampling period to the next sampling period are computed. As a result of comparison between the tables 163 and 164, it is determined by computation that the number of pixels the intermediate transfer belt 31 has moved is 3 in the direction x and 2 in the direction y.

The distance of relative movement can be computed from the relative movement amount computed as described above. Specifically, assuming that a sampled image has shifted 3 pixels in the direction x as the conveying direction relative to a previous sampled image, it is determined by computation that the intermediate transfer belt 31 has moved 30 μm if the size of one pixel is 10 μm. At this time, assuming that the sampling period is 1 kHz, it is determined by computation that the relative speed is 0.03 mm×1 kHz=30 mm/sec.

Similarly, with respect to the direction y, assuming that a sampled image has shifted 2 pixels in the direction −y perpendicular to the conveying direction relative to a previous sampled image, it is determined by computation that the intermediate transfer belt has moved 20 μm toward the rear in the shift direction if the size of one pixel is 10 μm. Thus, the shift amount of the intermediate transfer belt 31 can be computed.

Figure 22:
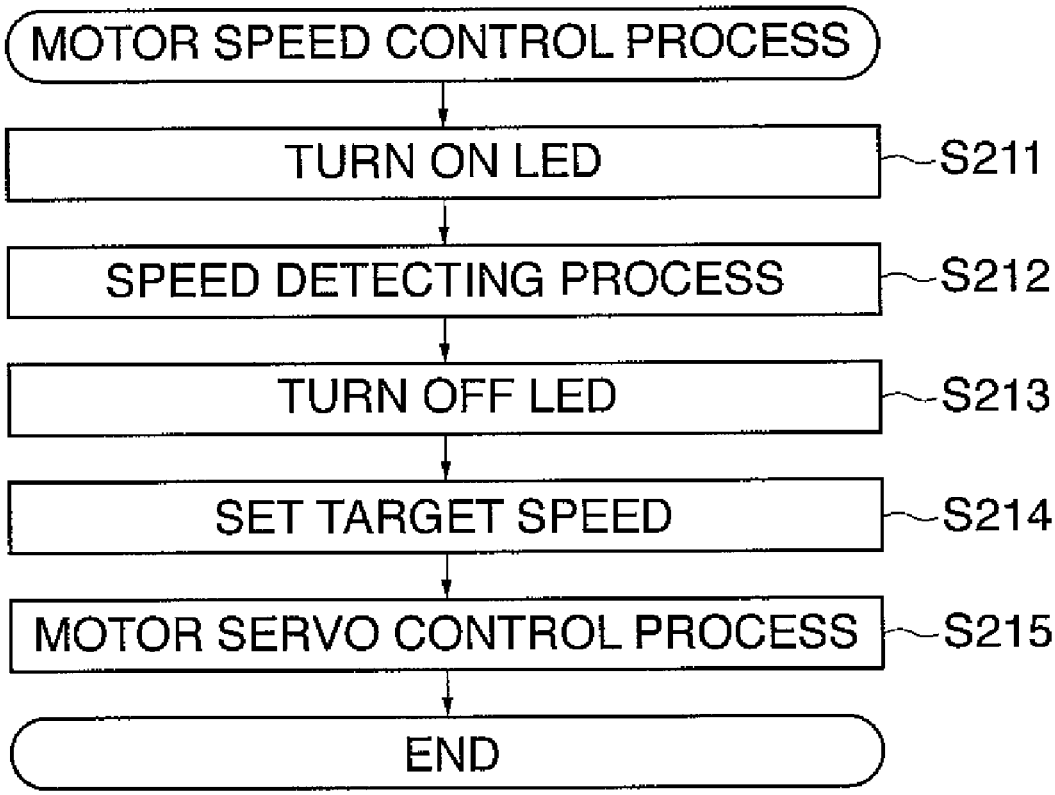
FIG. 22 is a flow chart of a motor speed control process carried out by the DSP in FIG. 9.

Next, a description will be given of the motor speed control process using the centroid computation method, which is carried out by the image forming apparatus according to the present embodiment. FIG. 22 is a flow chart of the motor speed control process.

Upon the start of the motor speed control process, first, the DSP 50 causes the LED 601 to light up and irradiate LED light onto the surface of the intermediate transfer belt 31 (step S211). Next, the DSP 50 carries out a speed detecting process (step S212), described later with reference to FIG. 23. After carrying out the speed detecting process, the DSP 50 turns off the LED 601 (step S213) and sets a target speed of the transfer belt drive motor 56 (step S214). In the step S214, the target speed of the transfer belt drive motor 56 is set so that the running speed of the intermediate transfer belt 31 becomes equal to the target running speed and be kept at this speed in accordance with the average relative speed of the intermediate transfer belt 31 computed in the speed detecting process. A motor servo control process is then carried out on the transfer belt drive motor 56 (step S215). The motor servo control process carried out in the step S215 is identical with the motor servo control process (FIG. 16) carried out in the first embodiment described above, and therefore description thereof is omitted.

Figure 23:
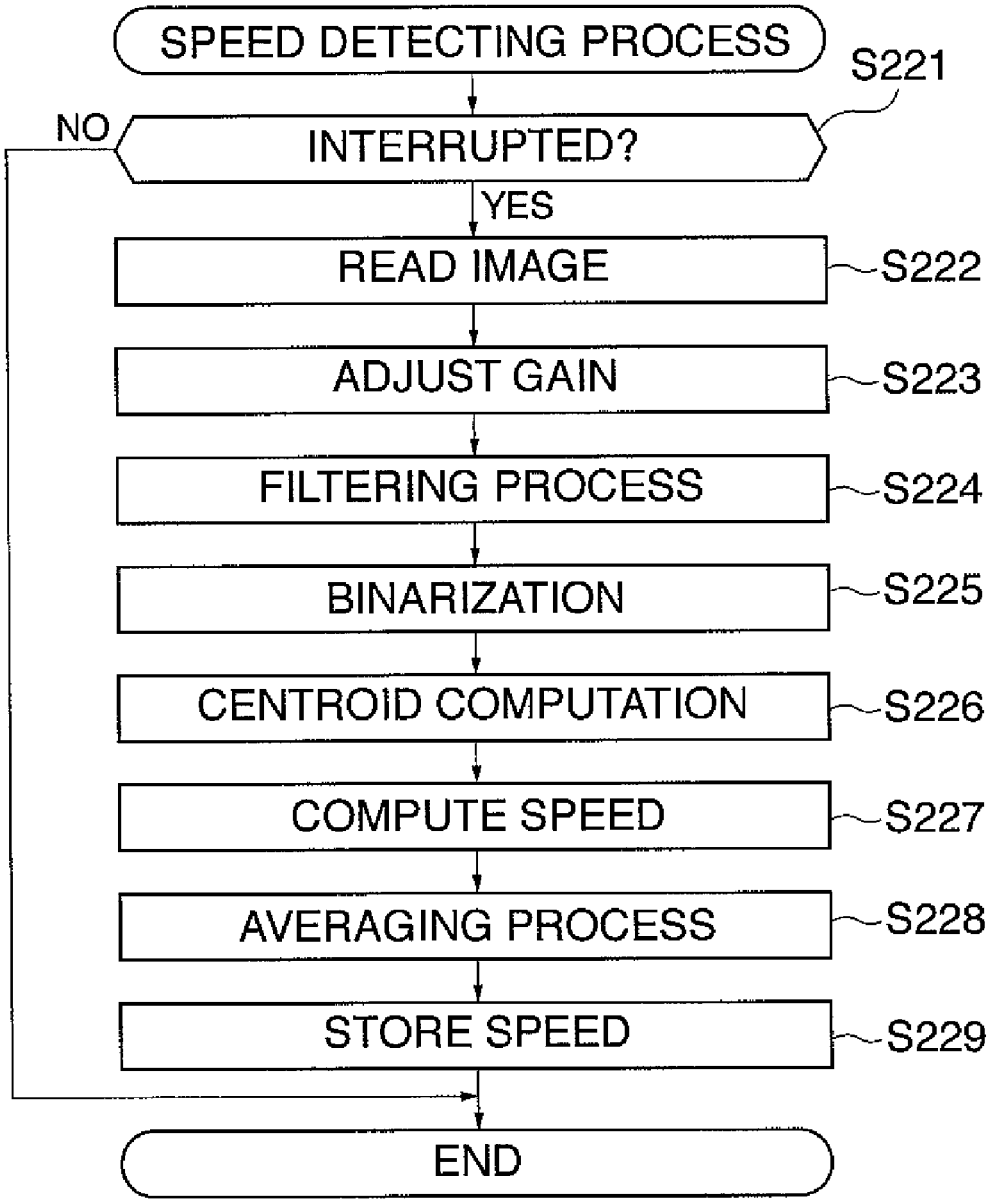
FIG. 23 is a flow chart of a speed detecting process in the motor speed control process in FIG. 22.
Figure 24:
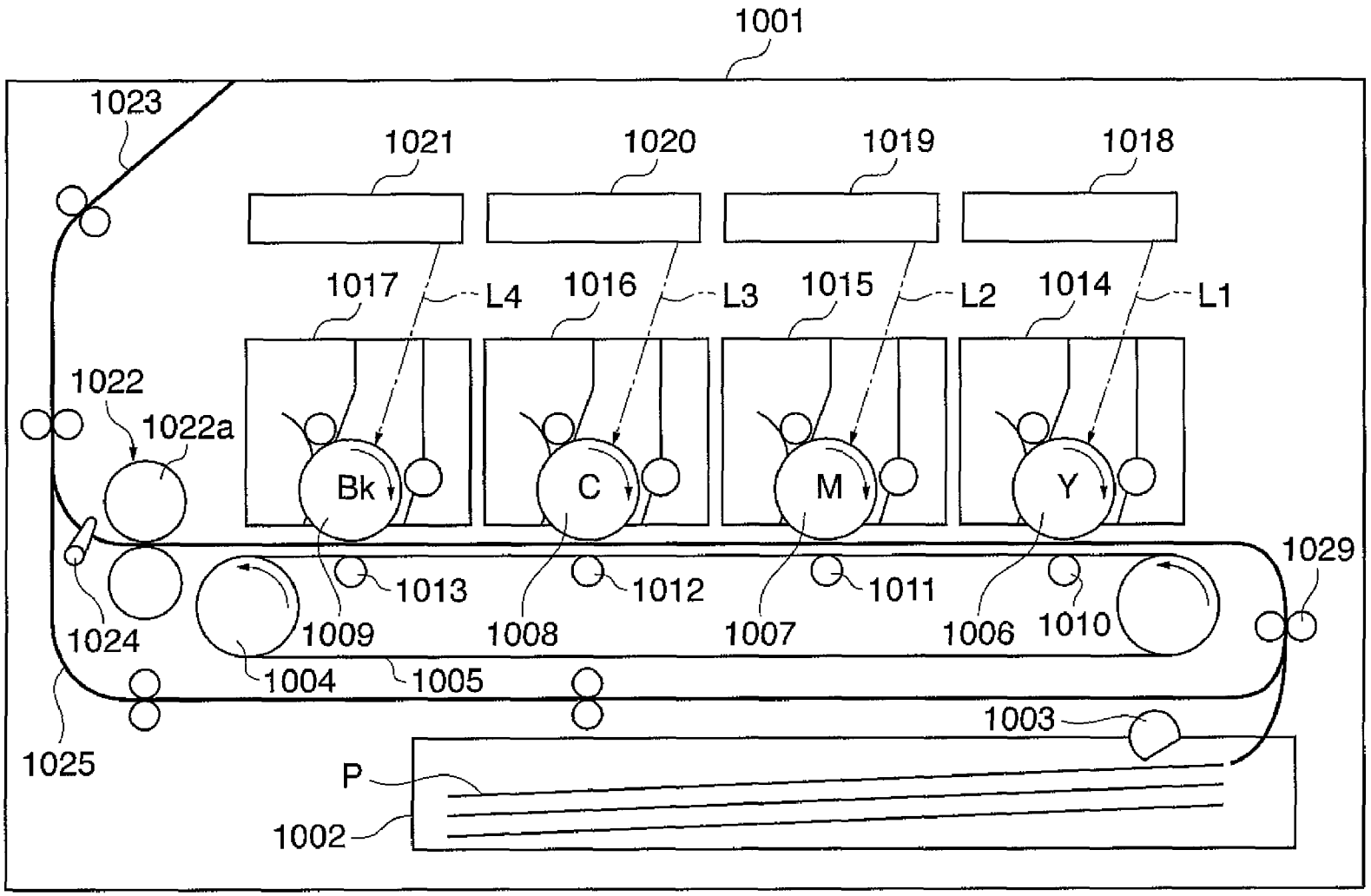
FIG. 24 is a diagram showing an example of conventional tandem-type image forming apparatuses.

Next, a description will be given of the speed detecting process in which the speed of the transfer belt drive motor 56 is detected in the step S212 of the motor speed control process in FIG. 22. FIG. 23 is a flow chart of the speed detecting process carried out in the step S212 of the motor speed control process.

First, an interrupt signal for determining a sampling period (for example, 1 ms) based on the clock signal S2 is monitored (step S221). If the interrupt signal is not received, the present process is terminated. On the other hand, if the interrupt signal is received, the CMOS sensor 602 reads a surface pattern of the intermediate transfer belt 31 upon receipt of the interrupt signal to create a surface image (for example, the image 72 in FIG. 10) (step S222). The surface image created in the step S222 is then analog-to-digital converted by the A/D converter 612, and the gain of the filter circuit 613 is adjusted so that the optimum surface image can be created from the surface pattern detected by the CMOS sensor 602 (step S223). Next, the filter circuit 613 carries out filtering on the analog-to-digital converted surface image (step S224). In the filtering, 8-bit and 256-tone data detected by the CMOS sensor 602 is converted into 16-tone data, and components such as noise are removed from the detected data. The sampling control section 501 then samples the filtered surface image.

Next, binarization of the sampled image (surface image 73) sampled by the sampling control section 501 is carried out as described above to create a binarized image (see FIGS. 20A, 20B, 21A, and 21B) (step S225). The centroids of the created binarized images are then computed using the centroid computation method described above (step S226). The computed centroids of the binarized image are stored in the image memory 503. The relative speed of the intermediate transfer belt 31 is derived from a difference between the values of centroids computed in the previous processing and the value of centroids computed in the present processing, as well as the sampling period (step S227). The average relative speed of the intermediate transfer belt 31 is then computed by averaging the relative speeds of the intermediate transfer belt 31 computed over a predetermined time period set in advance (step S228). The computed average relative speed is then stored in the image memory 503 (step s229), followed by termination of the speed detecting process.

It should be noted that regarding the shift control process as well, the shift amount of the intermediate transfer belt 31 is not computed using pattern matching of images as in the first embodiment, but is computed using the centroid computations method based on binarized data as is the case with the motor speed control process described above to control the steering motor. For this reason, detailed description of the shift control process is omitted.

As described above, the image forming apparatus according to the third embodiment of the present invention uses the CMOS sensor 602 to detect a surface pattern of the intermediate transfer belt 31 in a predetermined sampling period to create a sampled image. The DSP 50 then computes the centroids of the sampled image and then computes the relative speed and shift amount of the intermediate transfer belt 31 based on the computed centroids as well as centroids of a surface image sampled previously. The DSP 50 then servo-controls the intermediate transfer belt drive motor 56 so that the computed relative speed can be 0, that is, the rotational speed of the intermediate transfer belt drive motor 56 can be equal to a target speed. The DSP 50 also drives the steering motor 81 to adjust the position of the intermediate transfer belt 31 in the shift direction so that the computed shift amount of the intermediate transfer belt 31 can be within a predetermined range. Thus, the rotational speed of the intermediate transfer belt drive motor 56 can be controlled to the target speed by servo control mentioned above even when the intermediate transfer belt drive motor 56 expands due to increased temperature in the apparatus. For this reason, the running speed of the intermediate transfer belt 31 can be controlled to a fixed speed (target running speed), so that color shift and image blurring caused by increased temperature in the apparatus can be reduced and therefore high-quality images can be obtained. In addition, since the shift of the intermediate transfer belt 31 is controlled as well, color shift and image blurring can be further reduced, and therefore higher-quality images can be obtained.

It should be noted that the motor speed control process and the shift control process using the centroid computation method in the third embodiment described above may also be applied to the image forming apparatus having no intermediate transfer member according to the second embodiment described above.

Also, although in the first to third embodiments described above, the intermediate transfer belt or the transfer material bearing belt is given as an example of the belt of which shift is controlled, this is not limitative. For example, the present invention may be applied to shift control of a fixing belt that fixes toner images on a transfer material by applying heat.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-098770 filed Mar. 31, 2006, which is hereby incorporated by reference herein in its entirety.

What is claimed is:

1. An image forming apparatus comprising:

an intermediate transfer belt onto which images formed on an image bearing member are transferred;

a reading unit adapted to read surface patterns of said intermediate transfer belt;

a controller adapted to control movement of said intermediate transfer belt in a transverse direction perpendicular to a moving direction thereof based on the surface patterns of said intermediate transfer belt read by said reading unit;

a computing unit adapted to compute an amount of movement of said intermediate transfer belt in the transverse direction perpendicular to the moving direction based on the surface patterns of said intermediate transfer belt read by said reading unit, wherein said computing unit is adapted to compute the amount of movement of said intermediate transfer belt in the transverse direction and also compute a speed of said intermediate transfer belt in the moving direction based on the surface patterns of said intermediate transfer belt read by said reading unit;

a sampling unit adapted to, at intervals of predetermined sampling periods, sample images of the surface patterns of said intermediate transfer belt read by said reading unit; and an image storage unit adapted to store at least one of the images sampled by said sampling unit, wherein said computing unit is adapted to compute the speed of said intermediate transfer belt in the moving direction and the amount of movement of said intermediate transfer belt in the transverse direction perpendicular to the moving direction based on the sampled images and the images stored in said image storage unit.

2. An image forming apparatus according to claim 1, wherein said computing unit is adapted to compute a relative speed of said intermediate transfer belt in the moving direction by carrying out a relative comparison operation in which the sampled image and the sampled image sampled previously are compared with each other.

3. An image forming apparatus comprising:

an intermediate transfer belt onto which images formed on an image bearing member are transferred;

a reading unit adapted to read surface patterns of said intermediate transfer belt;

a controller adapted to control movement of said intermediate transfer belt in a transverse direction perpendicular to a moving direction thereof based on the surface patterns of said intermediate transfer belt read by said reading unit;

a computing unit adapted to compute an amount of movement of said intermediate transfer belt in the transverse direction perpendicular to the moving direction based on the surface patterns of said intermediate transfer belt read by said reading unit, wherein said computing unit is adapted to compute the amount of movement of said intermediate transfer belt in the transverse direction and also compute a speed of said intermediate transfer belt in the moving direction based on the surface patterns of said intermediate transfer belt read by said reading unit; and a sampling unit adapted to, at intervals of predetermined sampling periods, sample images of the surface patterns of said intermediate transfer belt read by said reading unit, and wherein said computing unit is adapted to compute centroids of the sampled images of the surface patterns of said intermediate transfer belt at intervals of the sampling periods and carries out a relative comparison operation in which the computed centroids are compared with each other to compute the speed of said intermediate transfer belt in the moving direction and the amount of movement of said intermediate transfer belt in the transverse direction perpendicular to the moving direction.

4. An image forming apparatus comprising:

an intermediate transfer belt onto which images formed on an image bearing member are transferred;

a reading unit adapted to read surface patterns of said intermediate transfer belt; and a controller adapted to control movement of said intermediate transfer belt in a transverse direction perpendicular to a moving direction thereof based on the surface patterns of said intermediate transfer belt read by said reading unit, wherein said reading unit comprises an illumination member adapted to irradiate light onto said intermediate transfer belt, a photoelectric conversion element adapted to convert the light from said intermediate transfer belt illuminated by said illumination member into an electric signal, and an image-forming lens adapted to cause the light from said intermediate transfer belt to form an image on said photoelectric conversion element, and wherein said reading unit comprises one of a CCD sensor and a CMOS sensor having a plurality of pixels as said photoelectric conversion element, and an A/D converter adapted to convert an analog signal from one of said CCD sensor and said CMOS sensor into a digital signal.

* * * * *